US008607973B2

(12) United States Patent
Il et al.

(10) Patent No.: US 8,607,973 B2
(45) Date of Patent: Dec. 17, 2013

(54) PACKAGING STRUCTURE FOR ROLL PAPER

(75) Inventors: Takashi Il, Tokyo (JP); Toshifusa Hirano, Tokyo (JP); Wataru Oyama, Tokyo (JP); Hisato Yoshii, Okayama (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 13/555,295

(22) Filed: Jul. 23, 2012

(65) Prior Publication Data

US 2012/0285853 A1 Nov. 15, 2012

Related U.S. Application Data

(62) Division of application No. 12/733,251, filed as application No. PCT/JP2008/064870 on Aug. 21, 2008, now Pat. No. 8,292,071.

(30) Foreign Application Priority Data

| | | |
|---|---|---|
| Aug. 28, 2007 | (JP) | 2007-220607 |
| Aug. 28, 2007 | (JP) | 2007-220632 |
| Aug. 28, 2007 | (JP) | 2007-220635 |
| Dec. 7, 2007 | (JP) | 2007-317558 |

(51) Int. Cl.
*B65D 71/00* (2006.01)

(52) U.S. Cl.
USPC ..... 206/225; 206/395; 206/408; 206/413

(58) Field of Classification Search
USPC ..... 206/225, 389, 395, 397, 407, 408, 413, 206/416, 485, 523, 591, 592, 594; 242/588.6, 596.7
See application file for complete search history.

(56) References Cited

U.S. PATENT DOCUMENTS

| | | | |
|---|---|---|---|
| 2,782,911 | A | 2/1957 | Fisher |
| 3,991,878 | A | 11/1976 | Serio, Jr. et al. |

(Continued)

FOREIGN PATENT DOCUMENTS

| | | | |
|---|---|---|---|
| JP | 56-138083 | | 10/1981 |
| JP | 02-296689 | A | 12/1990 |

(Continued)

OTHER PUBLICATIONS

International Search Report dated Sep. 22, 2008, issued on PCT/JP2008/064870.

(Continued)

*Primary Examiner* — Luan K Bui
(74) *Attorney, Agent, or Firm* — Edwards Wildman Palmer LLP

(57) ABSTRACT

The present invention provides a structure for storing coreless roll paper R having a hollow portion in the axis portion instead of a winding core, wherein the structure includes an outer case 2 for storing roll paper R; and a lower holding member and an upper holding member 4 respectively having concave portions 31,41 each having an inside diameter that closely matches the outside diameter of the roll paper R, each of the lower holding member 3 and the upper holding member 4 having an external shape that fits the outer case 2, wherein the lower holding member 3 is disposed in the outer case 2 with the concave portion 31 facing upward, and the upper holding member 4 is disposed in the outer case 2 at the location above the lower holding member 3 with its concave portion 41 facing downward.

5 Claims, 23 Drawing Sheets

(56) References Cited

U.S. PATENT DOCUMENTS

| | | | | | |
|---|---|---|---|---|---|
| 4,399,157 | A | * | 8/1983 | Caporaso | 206/594 |
| 4,823,956 | A | * | 4/1989 | Belisle | 206/523 |
| 4,826,008 | A | * | 5/1989 | Cloosterman | 206/413 |
| 4,883,178 | A | * | 11/1989 | Thiele et al. | 206/391 |
| 4,903,833 | A | * | 2/1990 | Beery | 206/407 |
| 5,385,232 | A | | 1/1995 | Foos et al. | |
| 5,398,808 | A | | 3/1995 | Chen et al. | |
| 5,462,171 | A | | 10/1995 | Moog et al. | |
| 5,590,786 | A | * | 1/1997 | Jaycox | 206/587 |
| 5,611,433 | A | | 3/1997 | Levy | |
| 6,805,240 | B2 | * | 10/2004 | Smarr et al. | 206/416 |
| 6,896,424 | B2 | * | 5/2005 | Hara et al. | 206/397 |
| 7,789,239 | B2 | * | 9/2010 | Juliano | 206/592 |

FOREIGN PATENT DOCUMENTS

| | | | |
|---|---|---|---|
| JP | 07-069341 | A | 3/1995 |
| JP | 7069341 | | 3/1995 |
| JP | 11-198987 | A | 7/1999 |
| JP | 11-334763 | A | 12/1999 |
| JP | 2000-347354 | A | 12/2000 |
| JP | 3089503 | | 10/2002 |
| JP | 2003-137356 | A | 5/2003 |
| JP | 2004-307063 | A | 11/2004 |

OTHER PUBLICATIONS

Supplementary European Search Report for European Patent Application No. 08792591.3 issued Mar. 15, 2011.

* cited by examiner fig.2
(a)
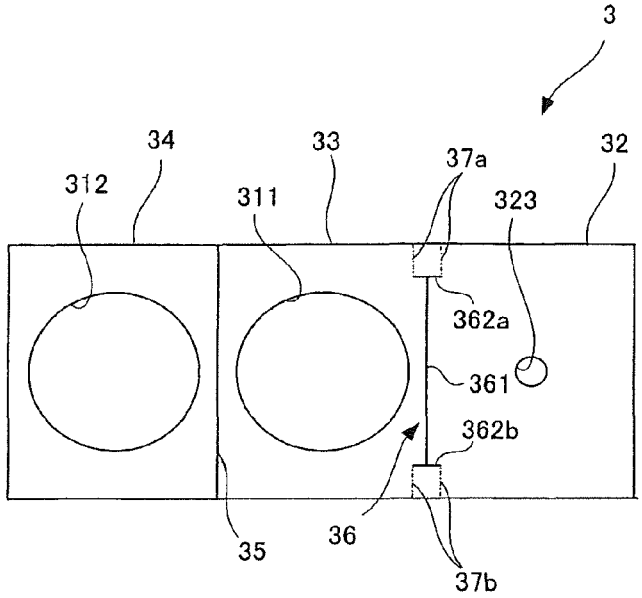
(b)
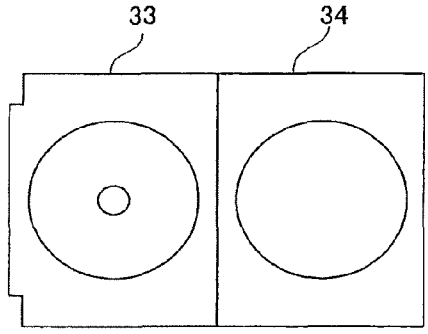
(c)
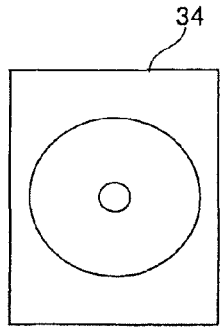

fig.10
(a)
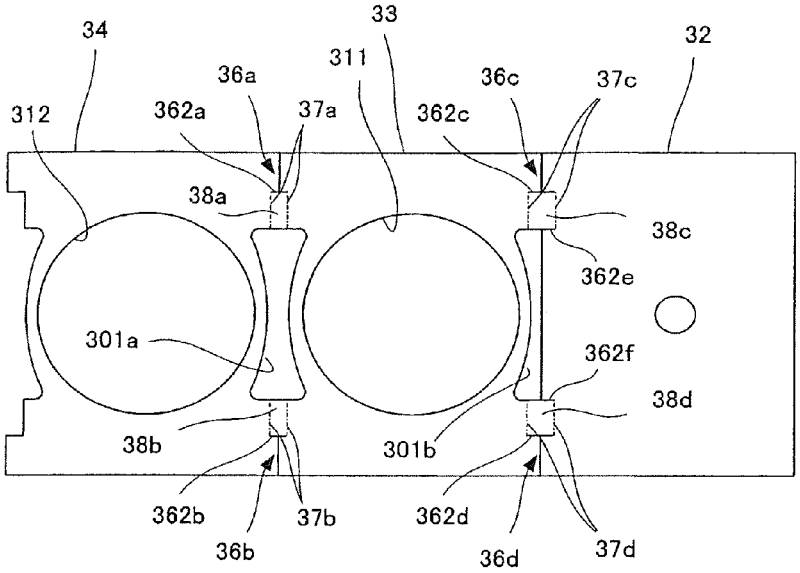
(b)
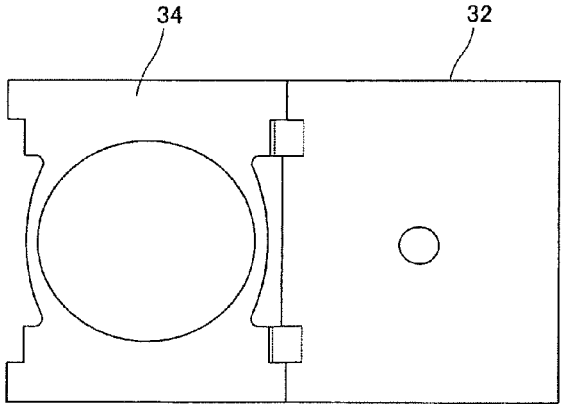
(c)
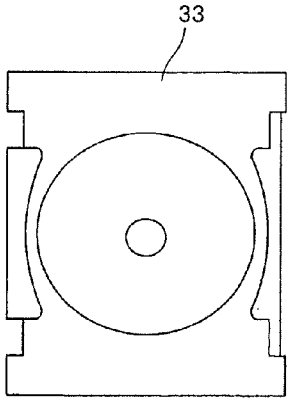

fig.17
(a)
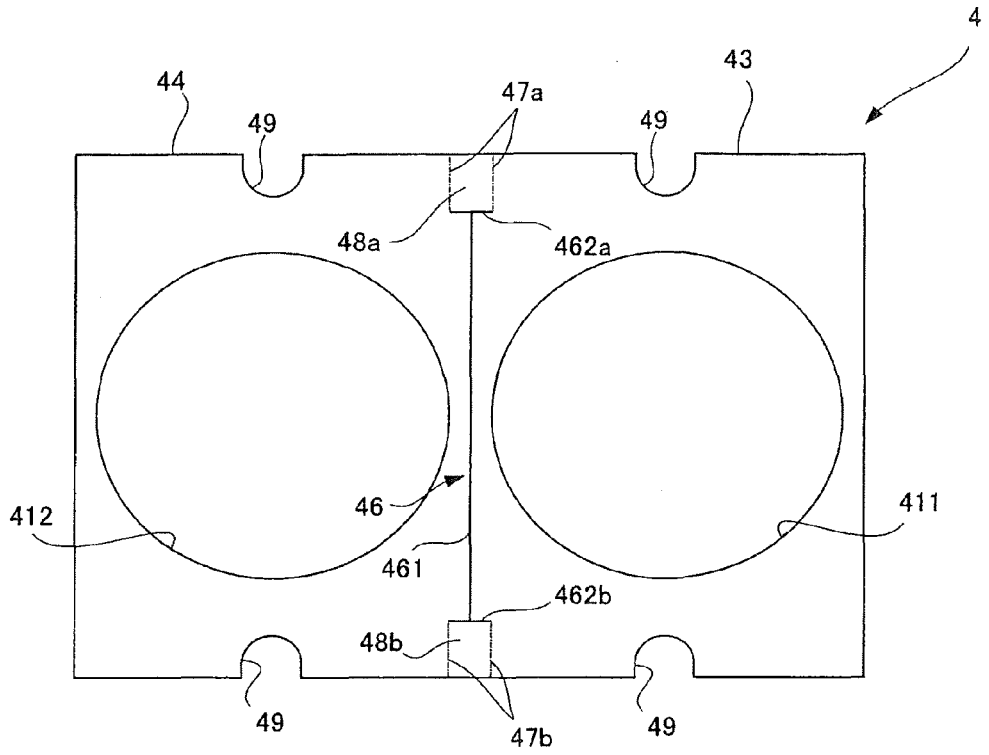
(b)
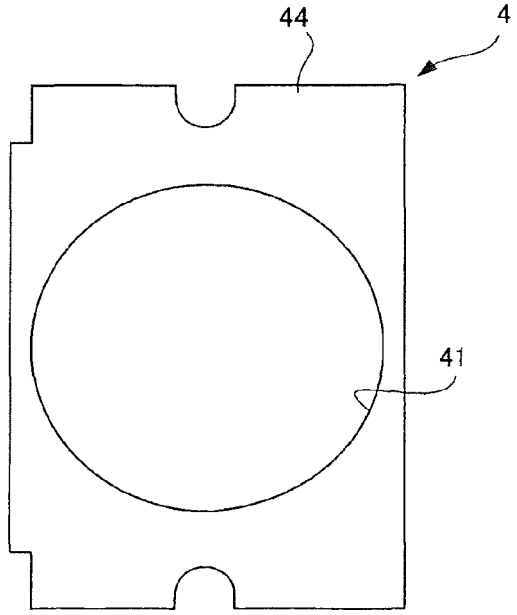

fig.22]
(a)
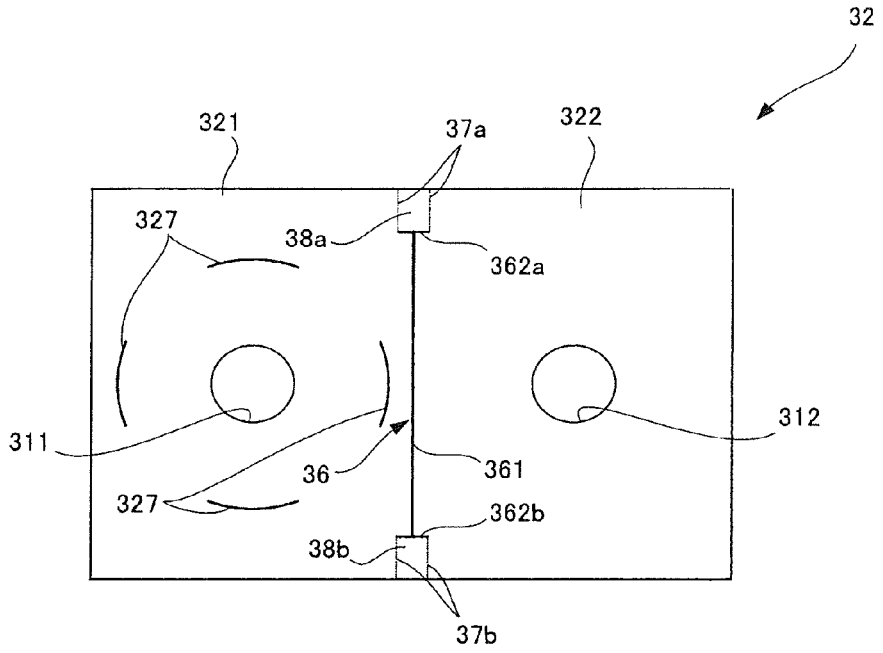
(b)
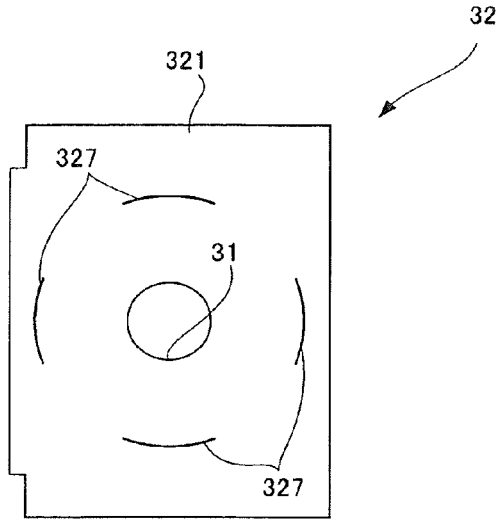

fig.23
(a)
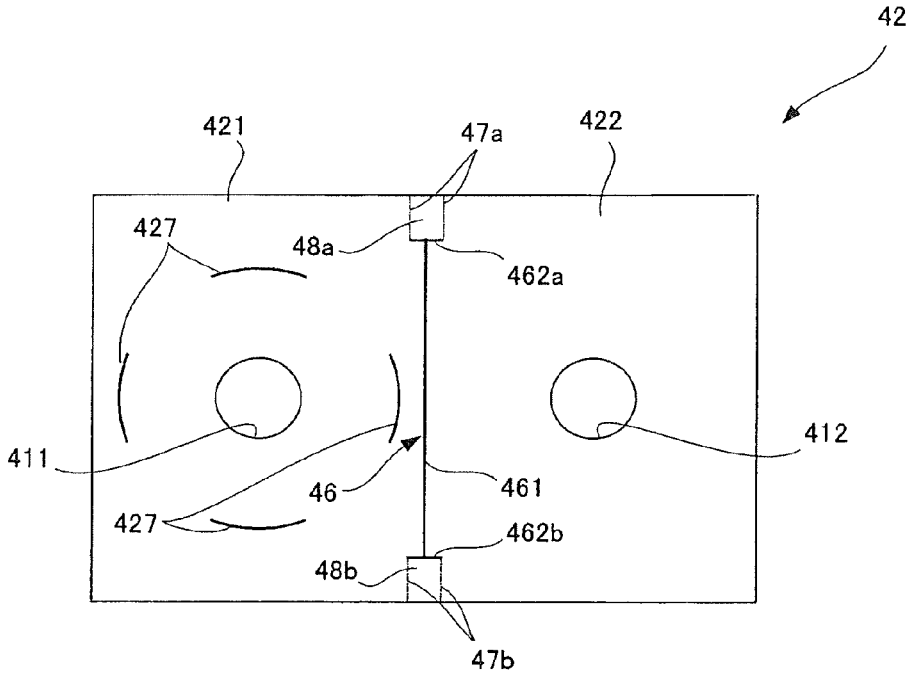
(b)
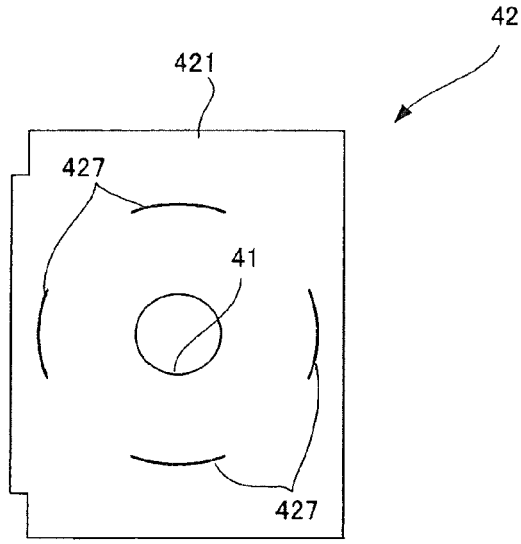

fig.26
(a)
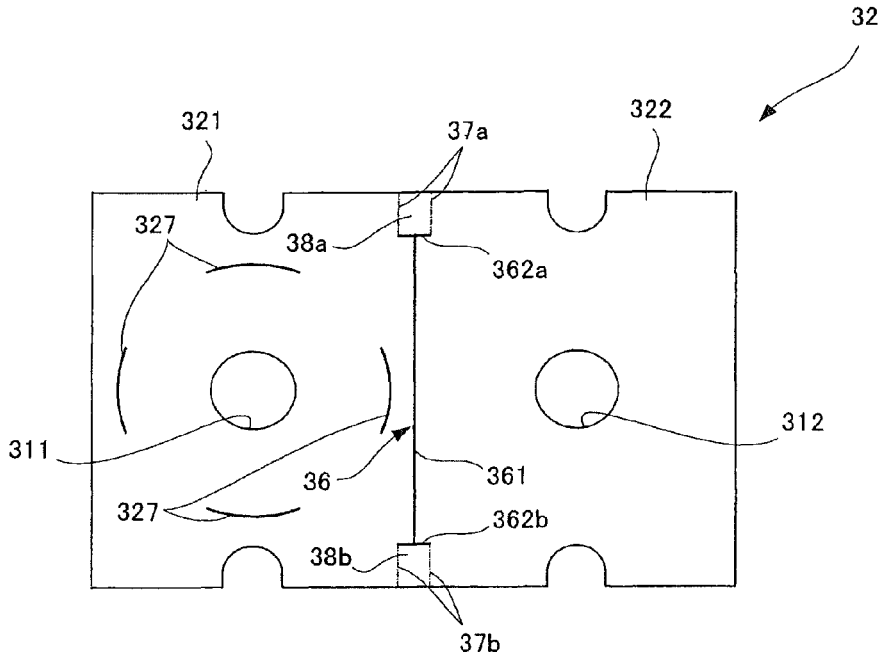
(b)
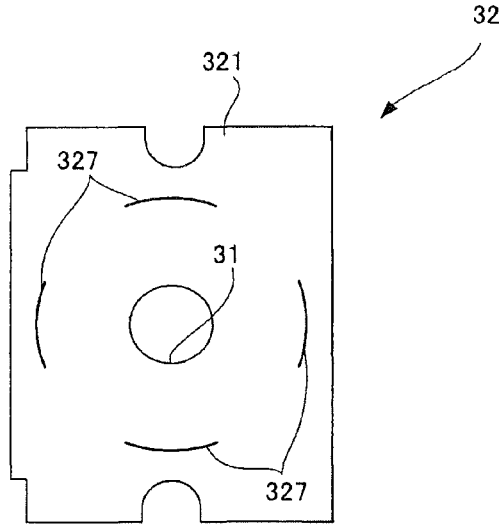

PACKAGING STRUCTURE FOR ROLL PAPER

This application is a divisional application of U.S. application Ser. No. 12/733,251, filed Feb. 19, 2010 (U.S. Pat. No. 8,292,071) which claims the right of priority under 35 U.S.C. §119 based on Japanese Patent Application Nos. 2007-220607, 2007-220632, 2007-220635 and 2007-317558, filed Aug. 28, 2007, Aug. 28, 2007, Aug. 28, 2007 and Dec. 7, 2007, respectively.

TECHNICAL FIELD

The present invention relates to a package structure for roll paper. More specifically, the present invention relates to a package structure for storing coreless roll paper.

BACKGROUND ART

Conventionally, roll paper has been commonly used for recording devices, such as business-use printers. However, if the roll paper were placed in a corrugated box without support, the roll paper would move inside the corrugated box. This would damage the outer surface, edge portions, etc., of the roll paper. In order to prevent such damage, for example, in the package structure for roll paper disclosed in Patent Document 1, a bearing member is provided on each edge portion of a winding-core-equipped roll paper, and the bearing of each bearing member is inserted into the winding core of the roll paper to support the roll paper in the corrugated box.

Patent Document 1: Japanese Unexamined Patent Publication No. 1995-69341

DISCLOSURE OF THE INVENTION

Technical Problem

In order to meet demands for reducing cost, saving resources, etc., coreless-type roll paper, i.e., roll paper having no winding core, is gradually becoming more popular. Because such coreless roll paper has a hollow structure at its axis portion instead of a winding core, the strength of the axis portion is inferior to that of roll paper having a winding core. Therefore, even if the bearing of the bearing member is inserted into the axis portion of the coreless roll paper in the manner described above, the roll paper cannot be held securely in a satisfactory manner due to the insufficient strength of the axis portion.

An object of the present invention is to provide a package structure for roll paper in which even a coreless roll paper, i.e., a roll paper having no winding core, can be reliably held.

Solution to Problem

The package structure for roll paper of the first invention has been made to solve the above-described problem. The package structure of the first invention is designed for packaging a coreless roll paper, i.e., a roll paper that has a hollow axis portion instead of a winding core, and comprises an outer case for storing the roll paper, and a lower holding member and an upper holding member each having a shape that fits the outer case and each formed with a concave portion having an inside diameter that closely matches the outside diameter of the roll paper. In this package structure, the lower holding member is disposed in the outer case with the concave portion facing upward, and the upper holding member is disposed in the outer case at a location above the lower holding member and with the concave portion facing downward.

In the package structure for roll paper of the first invention, the lower holding member and the upper holding member have external shapes that fit the outer case. Therefore, when they are disposed in the outer case, they are secured by their fit with the outer case. Furthermore, each of the lower holding member and the upper holding member has a concave portion having an inside diameter that closely matches the outside diameter of the roll paper. The lower holding member and the upper holding member are placed in the outer case in such a manner that the concave portions thereof face each other. This arrangement allows the lower end of the roll paper to fit in the concave portion of the lower holding member and the upper end of the roll paper to fit in the concave portion of the upper holding member. As described above, because the outer surface of the roll paper is held by the lower holding member and the upper holding member, which are secured by their fit with the outer case, even roll paper without a winding core can be securely held. Note that "having an inside diameter that closely matches the outside diameter of the roll paper" does not necessarily mean that the outside diameter of the roll paper is exactly the same size as the inside diameter of the concave portion. The inside diameter merely needs to be such that the roll paper is securely held by the concave portion when the roll paper is placed in the concave portion. For example, the inside diameter of the concave portion of each holding member can be approximately 1 to 2 mm, and preferably approximately 1 to 1.5 mm, larger than the outside diameter of the roll paper. A buffer sheet or the like may be provided between the concave portions in the structure and the roll paper wherein each end of the roll paper is held by the concave portion of each holding member. In this case, the size of the concave portions can be selected so that the roll paper is securely held by having a buffer sheet lying therebetween.

The package structure for roll paper of the first invention may be varied. However, it is preferable that at least one of the lower holding member and the upper holding member have an external shape that provides a space between the holding member and the inner wall of the outer case. As described above, by providing a space between the holding member and the inner wall of the outer case, the space can absorb shocks due to dropping, etc., and this will reduce the impact that is applied to the roll paper.

At least one of the lower holding member and the upper holding member comprises a plate-like base member, a plate-like first holding member, and a plate-like second holding member. The plate-like base member is formed so as to fit the outer case. The plate-like second holding member lies on the base member, and has a second through hole formed therein and an external shape that provides a space between the plate-like second holding member and the inner wall of the outer case. The plate-like first holding member lies on the second holding member, and has a first through hole formed therein and an external shape that provides a space between the plate-like first holding member and the inner wall of the outer case. It is preferable that one side of the first holding member be partially connected to one side of the second holding member, and that the first holding member be connected to the base member by some portion of the side that is opposite to that which is connected to the second holding member. It is also preferable that the concave portions be composed of the first and second through holes.

As described above, because the opposite side of the first holding member is connected to the base member via the second holding member, the first holding member is movable to some extent relative to the base member. This arrangement allows flexibility in coping with the shaking that inevitably occurs during transportation, so that the impact applied to the roll paper can be reduced.

It is preferable that a buffer sheet for reducing impact be further provided in such a manner that the sheet covers the concave portion of at least one of the lower holding member and the upper holding member. As described above, by providing a buffer sheet so as to cover the concave portion of the holding member, the buffer sheet is laid between the roll paper and the concave portion when the roll paper is placed in the concave portion. This further alleviates the impact applied to the roll paper.

In the package structure for roll paper of the first invention described above, holding members hold the outer surface of the roll paper. Therefore, in order to maintain satisfactory strength in the holding portion, the holding members inevitably become larger than those of a package structure in which a roll paper is held by a winding core. As a result, the outer case that accommodates the holding members also becomes larger. However, the package structures for roll paper of the second and third inventions described below make it possible to reliably hold coreless roll paper without enlarging the outer case.

The package structure for roll paper of the second invention is made to solve the above problem, wherein the axis portion is hollow and the roll paper has no winding core. The package structure comprises an outer case for storing the roll paper; a base member having an outside diameter that fits the outer case; a rod-like member extending upward from the base member and having an external shape that closely matches the inside diameter of the hollow portion of the roll paper; and an upper holding member having an external shape that fits the outer case and being formed with a concave portion having an inside diameter that closely matches the outside diameter of the roll paper. In the package structure for roll paper of the second invention, the upper holding member is placed in the outer case in a location above the base member with the concave portion facing downward.

In this structure, each of the base member and the upper holding member has an external shape that fits the outer case. Therefore, the base member and the upper holding member are secured by their fit with the outer case when placed therein. In this structure, the rod-like member extends upward from the base member that is secured by its fit with the outer case and the rod-like member has an outside diameter that closely matches the inside diameter of the hollow portion of the roll paper. This arrangement allows the roll paper to retain its position in the outer case when the roll paper is placed therein in such a manner that the rod-like member is inserted in the hollow portion. In the outer case, an upper holding member having a concave portion with an inside diameter that closely matches the outside diameter of the roll paper is fit in place above the base member. This arrangement prevents the upper end of the roll paper from moving relative to the lower end by inserting the upper end of the base-member-held roll paper into the concave portion of the upper holding member. As described above, in this structure, because the hollow portion of the roll paper is held by a rod-like member, it becomes unnecessary to hold the outer surface of the roll paper; therefore the size of the base member can be reduced. The upper holding member holds the outer surface of the roll paper; however, because the rod-like member holds the hollow portion of the roll paper, the upper holding member only has to prevent the movement of the roll paper. This makes it unnecessary to provide a large upper holding member. As a result, the outer case can be made smaller while still securely holding the coreless roll paper, thus preventing an increase in the transportation cost. Note that the concave portion of the upper holding member may also be formed as a through hole. Furthermore, the expression "an outside diameter that closely matches the inside diameter of the hollow portion of the roll paper" does not necessarily mean that the outside diameter of the rod-like member is identical to the inside diameter of the hollow portion. It is preferable that the outside diameter of the rod-like member and the inside diameter of the hollow portion vary within the range of ±0.3 to 1 mm, and more preferably within the range of ±0.3 to 0.5 mm. Likewise, the expression that describes a concave portion with "an inside diameter that closely matches the outside diameter of the roll paper" does not mean that the inside diameter of the concave portion of the upper holding member should be identical to the outside diameter of the roll paper, and the inside diameter of the concave portion of the upper holding member and the outside diameter of the roll paper should vary preferably within the range of ±0.3 to 1 mm, and more preferably within the range of ±0.3 to 0.5 mm.

The package structure for roll paper of the second invention may take various configurations. A preferable example thereof is that a base member is formed separately from a rod-like member, the base member comprising a concave portion having an inside diameter that closely matches the outside diameter of the rod-like member, and one end of the rod-like member being inserted into the concave portion.

It is preferable that the package structure for roll paper further comprise a buffer sheet for reducing impact and that the buffer sheet be provided so as to cover the concave portion of the upper holding member. In this structure, by providing a buffer sheet in such a manner that it covers the concave portion of the upper holding member, the buffer sheet lies between the roll paper and the concave portion when the upper end of the roll paper is inserted into the concave portion of the upper holding member. This reduces impact on the roll paper even if a force is applied to the outer case.

The package structure for roll paper of the third invention is made to solve the above problem, wherein the axis portion is formed as a hollow portion. The package structure for roll paper of the third invention is for packaging coreless roll paper having no winding core. The package structure comprises an outer case for storing roll paper; a lower base member having an external shape that fits the outer case, wherein the lower base member is placed on the bottom of the outer case; an upper base member having an external shape that fits the outer case, wherein the upper base member is removably secured to the inside of the outer case at a location above the lower base member in such a manner that the roll paper can be held between the upper base member and the lower base member; and a rod-like member having an outside diameter that closely matches the inside diameter of the hollow portion of the roll paper, wherein the rod-like member extends between the lower base member and the upper base member, each of the ends of the rod-like member is held by the lower base member or the upper base member, and at least one end of the rod-like member is removable from the lower base member or the upper base member. Each of the lower base member and the upper base member has slits around the outer periphery of the region facing the roll paper, or slits are formed to define a slightly larger circumference than that of the outer periphery.

In this structure, each of the ends of the rod-like member is secured to either the lower base member or the upper base member. Each of the lower base member and the upper base member has an external shape that fits the outer case and is removably secured to the inside of the outer case. The rod-like member has an outside diameter that closely matches the inside diameter of the hollow portion of the roll paper; therefore, by storing the roll paper in the outer case in such a manner that the rod-like member is inserted into the hollow portion of the roll paper, the roll paper can be secured to the inside of the outer case. As described above, because the roll paper is held by the rod-like member, it becomes unnecessary to hold the outer surface of the roll paper with the lower base member or the upper base member. As a result, the sizes of the lower base member and upper base member can be reduced. Furthermore, the lower base member and the upper base member sandwich the roll paper in the vertical direction, and each of the lower base member and the upper base member has slits along the outer periphery of the region facing the roll paper, or slits that are formed to define a slightly larger circumference than that of the outer periphery. The outer periphery of the region defined by the slits easily becomes concave. Therefore, even if the roll paper stored in the outer case starts to move in the vertical direction, or if the roll paper starts to lean, with a top or bottom edge portion thereof serving as a base, the motion of the roll paper will be absorbed. This reduces the pressure that is applied to the top or bottom surface, or to the top or bottom edge portion, that is in contact with either of the base members.

Note that the expression "the rod-like member has an outside diameter that closely matches the inside diameter of the hollow portion of the roll paper" does not mean that the outside diameter of the rod-like member is necessarily identical to the inside diameter of the hollow portion. It is preferable that the difference between the outside diameter of the rod-like member and the inside diameter of the hollow portion falls within the range of ±0.3 to 1 mm, and preferably within the range of ±0.3 to 0.5 mm. Furthermore, each of the lower base member and the upper base member has an external shape that fits the outer case; however, "an external shape that fits the outer case" does not mean that the external shape of the lower base member and that of the upper base member are exactly the same as the cross-sectional view of the outer case. As long as the lower base member and the upper base member are stably and horizontally secured to the inside of the outer case, the formation of a slight gap may be acceptable. Furthermore, the slits are formed along the outer periphery of the region facing the roll paper, or in such a manner that a slightly larger circumference than that of the outer periphery is formed. Here, the term "slightly larger circumference" means a diameter that is about 0.05 to 5 mm larger than the roll paper to be stored.

The package structure for roll paper of the third invention may take various configurations. It is preferable that, for example, the above-described slits be intermittently formed. This arrangement makes it possible to form the area of the base member surrounded by the slits and the other areas of the base member in an integral manner, thus simplifying the handling of the base member. Furthermore, by providing the slits, the force that results from dropping can escape from the slit area, and because other parts are integrally connected, the strength of the package structure is increased, preventing deformation caused by dropping.

It is preferable that a concave portion having an inside diameter that closely matches the outside diameter of the rod-like member be formed in at least one of the lower base member and the upper base member, and that the end of the rod-like member be inserted into the concave portion. Forming the rod-like member separately from the base members can simplify the production. Furthermore, because the rod-like member can be easily secured by simply inserting it into the concave portions of the base member, the rod-like member can be easily secured to the base member.

The above-described package structures for roll paper of the first to third inventions may further comprise a storage box that is disposed so as to fit the outer case at a location above the upper holding member or above the upper base member. This storage box can store an ink ribbon, etc. When an outer case is dropped, the bottom is generally the first part to contact the ground; therefore, the lower part of the outer case receives the largest impact. Because the storage box is located in the upper part of the outer case, the storage box will receive a smaller impact when dropped, thus protecting the ink ribbon or other components that have a low impact resistance.

It is preferable that the storage box comprise a box unit for storing an object, and vane-like portions extending outward from the side faces of the box unit. Because the box unit having an object stored therein is located in the outer case that is provided with the vane-like portions, when an impact is applied to the outer case, the vane-like portions will absorb the impact so that the box unit having a stored object therein can be reliably protected from the impact.

It is also preferable that the storage box further comprise a packing sheet for covering an object to be stored, wherein the packing sheet is stored in the storage box with the portion of sheet that remains after covering the object being rolled up. By covering the stored object with a packing sheet, the stored object can be reliably protected from impact. In this arrangement, the remaining packing sheet is stored in the storage box in a rolled up condition so that the rolled up packing sheet can absorb impacts, thus protecting the stored object more reliably from impacts.

The package structure for roll paper of the third invention comprises a storage box on top of the upper base member, so that the upper base member is pressed in the direction of the lower base member by the weight of the storage box and the object stored therein. In the present invention, roll paper is stored between the lower base member and the upper base member. In this arrangement, the roll paper can be securely fastened between the lower base member and the upper base member, by disposing the storage box having an object stored therein on top of the upper base member and pressing the upper base member in the direction of the lower base member.

Effects of Invention

The present invention provides a package structure for roll paper that can securely fasten roll paper even it has no winding core.

BRIEF DESCRIPTION OF THE DRAWINGS

FIGS. 2(*a*) to 2(*c*) are plan views showing the lower holding member according to the first embodiment before folding (a) and after folding (c).

FIGS. 10(*a*) and 10(*b*) are plan views showing the lower holding member and the upper holding member of a modified example of the first embodiment before folding (a) and after folding (b).

FIGS. 17(*a*) and 17(*b*) are plan views showing the upper holding member according to the second embodiment before folding (a) and after folding (b).

FIGS. 22(*a*) and 22(*b*) are plan views showing the base member according to the third embodiment before folding (a) and after folding (b).

FIG. 23 is a plan view showing the upper base member according to the third embodiment before folding (a) and after folding (b).

FIGS. 26(*a*) and 26(*b*) are plan views showing the lower base member (upper base member) according to a modified example of the third embodiment before folding (a) and after folding (b).

EXPLANATION OF REFERENCE NUMERALS

Figure 1:
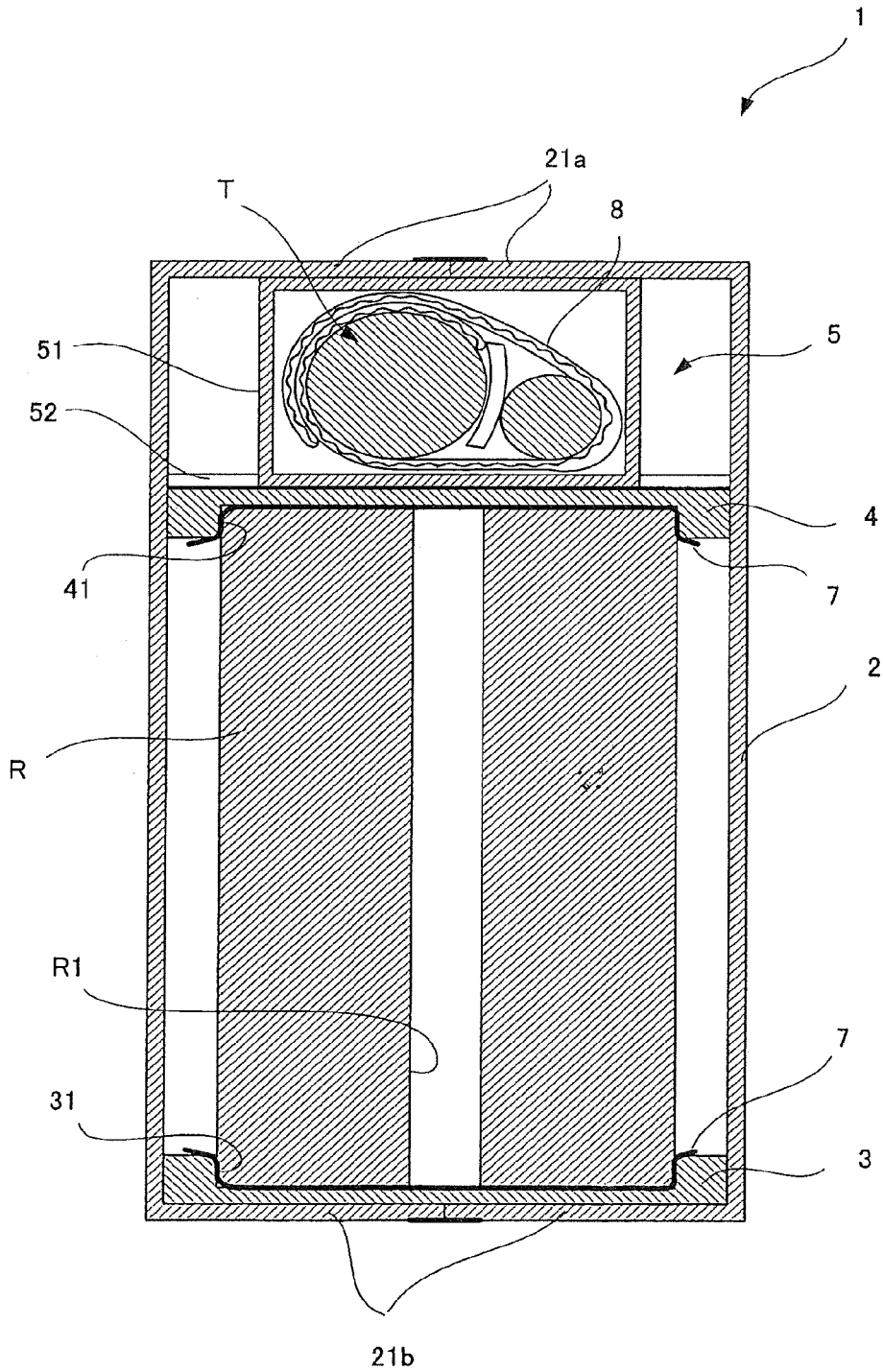
FIG. 1 is a front sectional view showing a package structure for roll paper according to the first embodiment.

1 package structure
2 outer case
3 lower holding member
4 upper holding member
5 storage box
31, 41 concave portions
32, 42 base members
39 rod-like member
327, 427 slits
R roll paper

BEST MODE FOR CARRYING OUT THE INVENTION

First Embodiment

Figure 3:
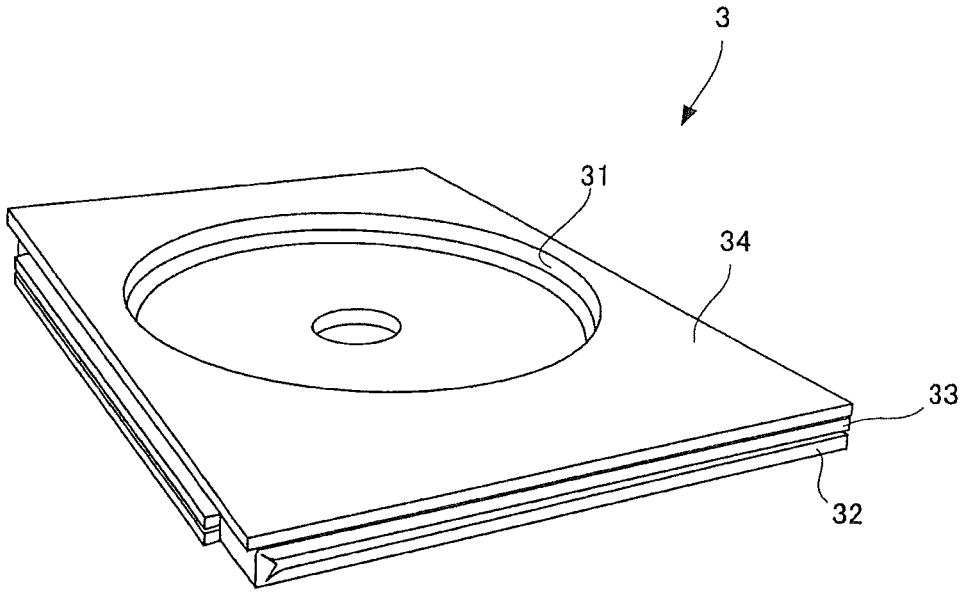
FIG. 3 is a perspective view showing the lower holding member according to the first embodiment.

A package structure according to the first embodiment of the present invention is described below with reference to the drawings. FIG. 1 is a front sectional view showing a package structure for roll paper according to the first embodiment. FIGS. 2(*a*) to 2(*c*) are plan views showing the lower holding member according to the first embodiment before folding (a) and after folding (c). FIG. 3 is a perspective view showing the lower holding member according to the first embodiment.

As shown in FIG. 1, a package structure 1 comprises a rectangular parallelepiped-like outer case 2. The outer case 2 sequentially comprises, from the bottom, a lower holding member 3 for holding the lower end of roll paper R; an upper holding member 4 for holding the upper end of the roll paper R; and a storage box 5 for storing an ink ribbon T. The roll paper R is held between the lower holding member 3 and the upper holding member 4. The roll paper R is cylindrical, and is stored having its axial direction in the vertical direction relative to the outer case 2. Instead of a winding core, the axis portion of the roll paper R has a hollow portion R1 having a circular cross-sectional shape and extending in the axial direction.

Each component composing the package structure 1 is described in detail below. The outer case 2 is formed to have a rectangular parallelepiped-like shape using corrugated paper or the like. In other words, the outer case 2 is formed as a so-called corrugated box, wherein the top surface is openable and closable by folding or unfolding a flap part 21*a*, and the bottom surface is openable and closable by folding or unfolding a flap part 21*b*. When the roll paper R is stored as shown in FIG. 1, the flap parts 21*a*,21*b* of the top and bottom surfaces are closed. The outer case 2 is kept closed by applying packaging tape or like adhesive tape thereto.

The lower holding member 3 is placed on the bottom surface of the closed outer case 2 with the concave portion 31 facing upward. As shown in FIGS. 2 and 3, the lower holding member 3 comprises a base member 32 having an external shape that is almost the same as the shape of the bottom surface of the outer case 2; a first holding member 33 in which a first through hole 311 is formed; and a second holding member 34 in which a second through hole 312 is formed. The first through hole 311 and the second through hole 312 have the same shape. A third through hole 323 considerably smaller than the first and second through holes is formed in the central part of the base member 32. The through hole 323 is formed in a size that allows an operator's finger to be inserted therein. This arrangement allows the operator to efficiently remove the lower holding member 3 from the outer case 2 using the through hole 323.

As shown in FIG. 2(*a*), the base member 32 is integrally formed with the first and second holding members 33,34. For example, they may be formed from a piece of corrugated paper. A slit line 35 is formed by making a slit, between the first holding member 33 and the second holding member 34, that does not reach the back surface. This allows the second holding member 34 to be mountain folded relative to the first holding member 33. By making another slit, between the first holding member 33 and the base member 32, that reaches the back surface, a slit line 36 having an I shape is formed. The I-shaped slit line 36 is composed of a vertical slit line 361 that extends vertically and horizontal slit lines 362*a*,362*b*, which extend horizontally and are connected to the upper end and the lower end of the vertical slit line 361. A folding line 37*a* is formed so as to extend from each of the left and right sides of the horizontal slit line 362*a*, which is connected to the upper end of the vertical slit line 361, toward the upper end of the lower holding member 3. Furthermore, a folding line 37*b* is formed so as to extend from each of the left and right sides of the horizontal slit line 362*b*, which is connected to the lower end of the vertical slit line 361, toward the lower end of the lower holding member 3. By forming the 1-shaped slit line 36 and the folding line 37, the first holding member 33 can be valley folded relative to the base member 32.

The folding steps to make the above-described lower holding member 3, which is formed from a piece of corrugated paper, into a configuration that can be used in the package structure 1 of the present embodiment are described below. The first lower holding member 33 is valley folded relative to the base member 32 from the condition where the lower holding member 3 is unfolded as shown in FIG. 2(*a*) (see FIG. 2(*b*)). From the condition shown in FIG. 2(*b*), the second holding member 34 is valley folded relative to the first holding member 33 (see FIG. 2(*c*)). As described above, when the lower holding member 3 is placed in the outer case 2, the lower holding member 3 comprises, as shown in FIG. 3, a first holding member 33 that lies on the base member 32, and a second holding member 34 that lies on the first holding member 33. In this arrangement, the first through hole 311 and the second through hole 312 are stacked one on top of the other, and a concave portion 31 is foamed by the thus-stacked first through hole 311 and second through hole 312. Note that the upper holding member 4 described later has the same structure as that of the above-described lower holding member 3.

The explanation continues with reference to FIG. 1. The lower holding member 3 having the above-described structure is placed on the bottom surface of the outer case 2 with the concave portion 31 facing upward. A buffer sheet 7 is provided so as to cover the concave portion 31. There is no limitation to the materials for the buffer sheet 7, and polyethylene, foamed polyethylene, etc., may be preferably used. To be more specific, Mirror-Matte is preferably used as polyethylene and Air Cap (both registered trademarks) or the like is preferably used as foamed polyethylene. Thereafter, the lower end of the roll paper R is inserted in the concave portion 31 that is covered with the buffer sheet 7. When the roll paper R is placed in the concave portion 31 having the buffer sheet 7 therebetween, the roll paper R fits the concave portion 31 and is securely held by the concave portion 31.

Figure 4:
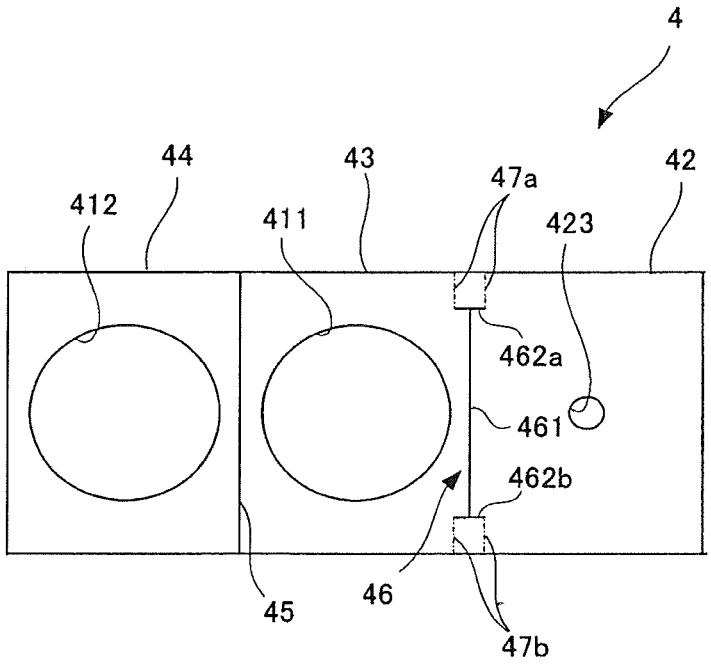
FIG. 4 is a development view showing the upper holding member according to the first embodiment before folding.
Figure 5:
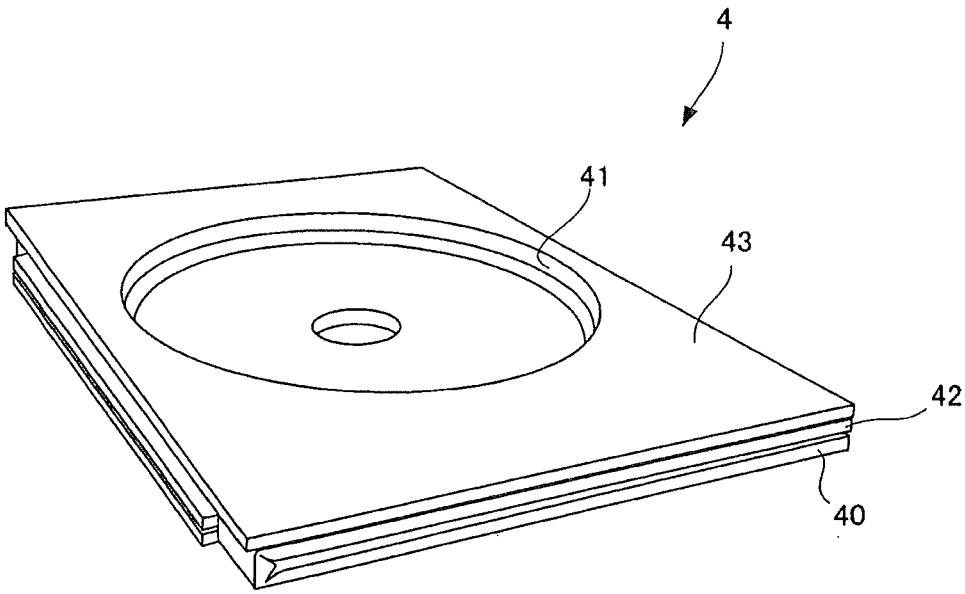
FIG. 5 is a perspective view showing the upper holding member according to the first embodiment.

An upper holding member 4 is placed on the roll paper R, and the upper end of the roll paper R is inserted into the concave portion 41 of the upper holding member 4. Similar to the lower holding member 3, the upper end of the roll paper R is inserted into the concave portion 41 of the upper holding member 4 with a buffer sheet 7 therebetween. Under such a condition, the upper end of the roll paper R fits the concave portion 41, so that the upper end of the roll paper R is securely held in the concave portion 41. As shown in FIGS. 4 and 5, the upper holding member 4 has the same structure as that of the lower holding member 3 described above. To be more specific, the upper holding member 4 comprises a base member 42; a first holding member 43 having a first through hole 411; and a second holding member 44 having a second through hole 412. The concave portion 41 is composed of the first through hole 411 and the second through hole 412.

Figure 6:
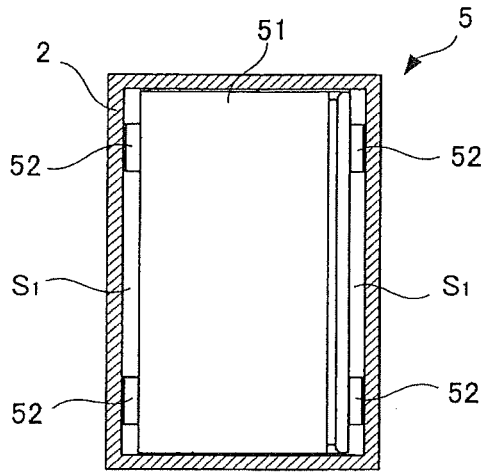
FIG. 6 is a plan view showing the storage box according to the first to third embodiments.
Figure 7:
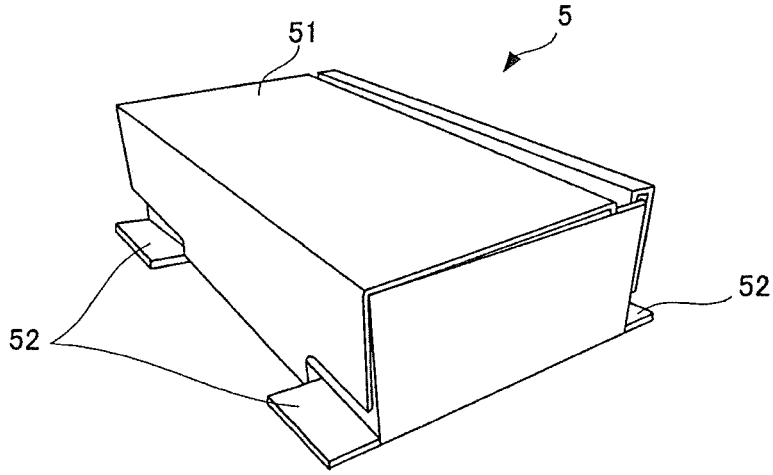
FIG. 7 is a perspective view showing the storage box according to the first to third embodiments.

A storage box 5 for storing an ink ribbon T (an object to be stored) is provided on the upper holding member 4. As shown in FIGS. 6 and 7, the storage box 5 comprises a box unit 51 and four vane-like portions 52. The box unit 51 is constructed so as to have a rectangular parallelepiped shape to store an ink ribbon T (an object to be stored) therein. Among the four vane-like portions 52, two of each of the portions extend from one of the side faces of the box unit 51. As shown in FIG. 6, each vane-like portion 52 extends either from the left or right side of the box unit 51 and contacts an inner wall of the outer case 2. This allows the storage box 5 to be secured to the inside of the outer case 2 by the vane-like portions 52 in the lateral directions in FIG. 6. Furthermore, because the length of the box unit 51 and the length of the outer case 2 are substantially the same in the vertical direction in FIG. 6, the storage box 5 fits the outer case 2. As described above, because the vane-like portions 52 are disposed between the right and left sides of the box unit 51 and the inner walls of the outer case 2, a space $S_1$ is formed between each of the right and left sides of the box unit 51 and the inner walls of the outer case 2.

Figure 8:
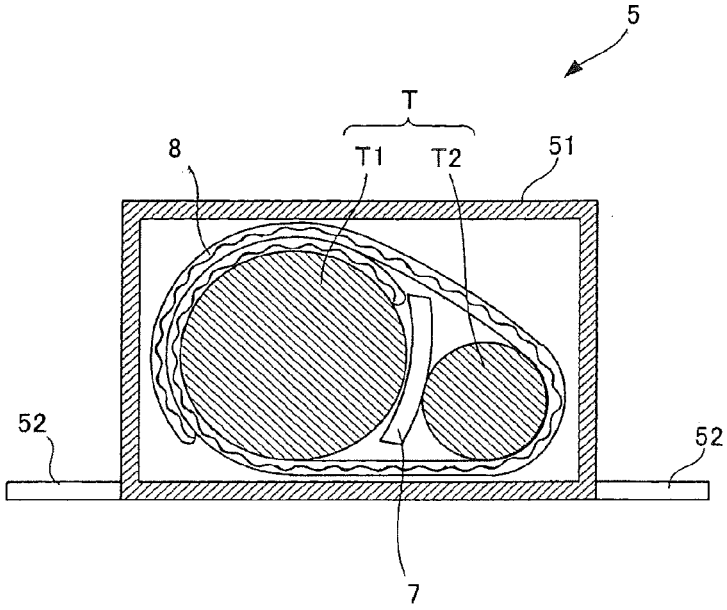
FIG. 8 is a front sectional view showing the storage box storing an ink ribbon that is covered with a packing sheet according to the first to third embodiments.

As shown in FIG. 8, the box unit 51 stores an ink ribbon T comprising a feed roll unit T1 and a wind-up roll unit T2, wherein the ink ribbon T is covered with a packing sheet 8. A buffer sheet 7 lies between the feed roll unit T1 and the wind-up roll unit T2. In such a condition, the packing sheet 8 covers the entire ink ribbon T. There is no limitation to the material for the packing sheet 8 as long as it protects the ink ribbon T, and polyethylene, foamed polyethylene, etc., is preferably used. To be more specific, Mirror-Matte is preferably used as polyethylene and Air Cap (both registered trademarks) or the like is preferably used as foamed polyethylene. In the present embodiment, the storage box 5 is used for storing an ink ribbon; however, the stored object is not limited to an ink ribbon, and the storage box 5 may store various other objects.

Figure 9:
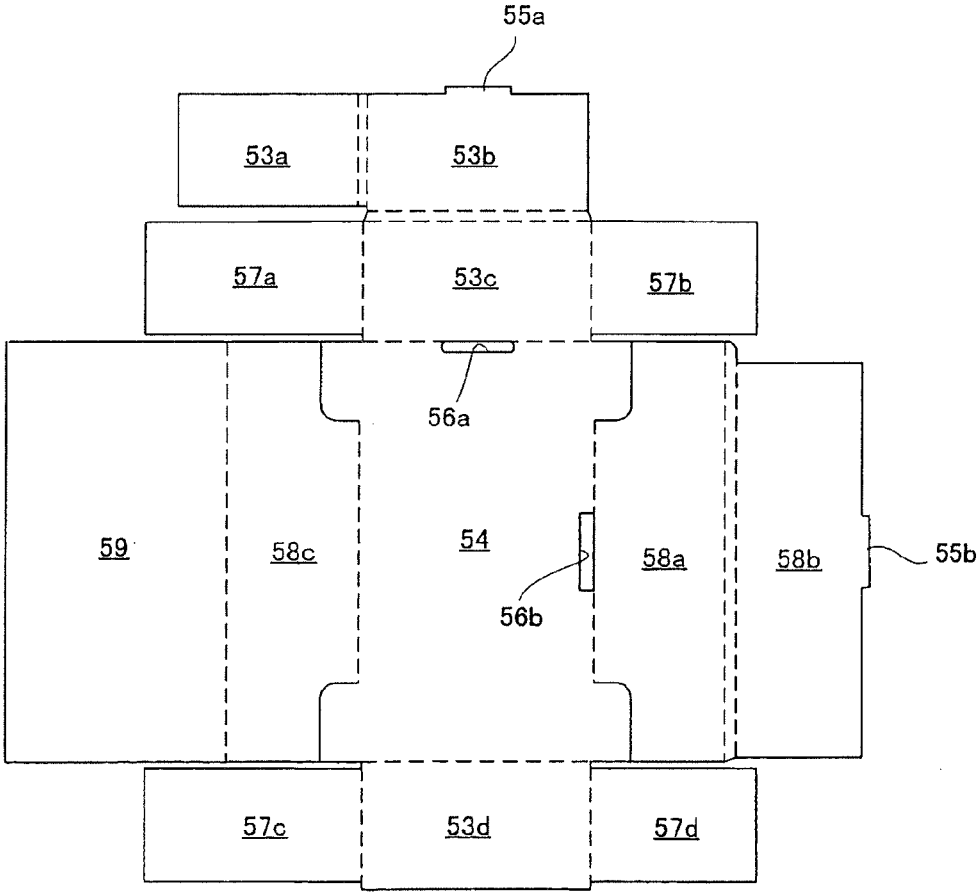
FIG. 9 is a development view showing the storage box according to the first to third embodiments before assembly.

The assembly procedure of the storage box 5 is described in detail below with reference to FIG. 9. Note that the dotted lines in FIG. 9 indicate the lines that can be folded into valley folds. First, a first shorter side face 53*a* is valley folded 180° to lie on top of a second shorter side face 53*b*. With the first shorter side face 53*a* in this folded condition, the second shorter side face 53*b* is then valley folded 180° to lie on top of a third shorter side face 53*c*. Thereafter, the third shorter side face 53*c* is valley folded 90° so that the third shorter side face 53*c* becomes perpendicular to the bottom surface 54 with the first and second shorter side faces 53*a*,53*b* lying on each other. Subsequently, a first engagement projection 55*a* formed on the second shorter side face 53*b* is inserted into a first engagement hole 56*a*. A fourth shorter side face 53*d* is then valley folded 90° to become perpendicular to the bottom surface 54. Thereafter, each of the inner side flaps 57*a* to 57*d* formed on the third and fourth shorter side faces 53*c*,53*d* are valley folded 90°. A first longitudinal face 58*a* is valley folded 90° so that it becomes perpendicular to the bottom surface 54. A second longitudinal face 58*b* is valley folded 180° so that the second longitudinal face 58*b* lies on the first longitudinal face 58*a* via inner side flaps 57*b*,57*d*. Thereafter, a second engagement projection 55*b* that is formed on the second longitudinal face 58*b* is inserted into a second engagement hole 56*b*. A third longitudinal face 58*c* is then valley folded 90° to become perpendicular to the bottom surface 54. A cover portion 59 is valley folded 90° to obtain a storage box 5 as shown in FIG. 7.

A packaging method using the above-described package structure 1 for roll paper is described with reference to the drawings. First, as shown in FIG. 1, an outer case 2 is prepared and a bottom surface is then formed by closing a flap 21*b* and applying packaging tape thereto. A lower holding member 3 is inserted into the outer case 2 in such a manner that the concave portion 31 faces upward, and the lower holding member 3 is then pressed down until the bottom surface of the lower holding member 3 contacts the bottom surface of the outer case 2. Note that because the lower holding member 3 has an external shape substantially the same as that of the bottom surface of the outer case 2 as seen in a plan view, the lower holding member 3 can be secured by its fit with the outer case 2.

Subsequently, a buffer sheet 7 is provided to cover the concave portion 31 of the lower holding member 3, and the lower end of the roll paper R is inserted into the concave portion 31 with the buffer sheet 7 therebetween. Thereafter, the buffer sheet 7 is placed on the upper end of the roll paper R, and the upper holding member 4 is then inserted in the outer case 2 in such a manner that its concave portion 41 faces downward. The upper holding member 4 is thereafter pressed down in the outer case 2 until the upper end of the roll paper R is inserted in and securely held by the concave portion 41 of the upper holding member 4. Note that the upper holding member 4 has an external shape as seen in a plan view that is substantially the same as the cross-sectional shape of the outer case 2. This arrangement allows the upper holding member 4 to be secured by its fit with the outer case 2.

Subsequently, the ink ribbon T is covered with a packing sheet 8 and then stored in the box unit 51 of the storage box 5. The storage box 5 that accommodates the ink ribbon T in the above-described condition is stored in the outer case 2. The storage box 5 is then pressed down until the bottom surface of the storage box 5 contacts the top surface of the upper holding member 4. In this arrangement, the storage box 5 is secured to the inside of the outer case 2 by means of a box unit 51 and four vane-like portions 52. The flap 21*a* of the outer case 2 is closed and packaging tape is applied thereto, thus closing the top surface of the outer case 2.

As described above, in the first embodiment, the outer surface of the lower end of the roll paper R is held by the concave portion 31 of the lower holding member 3 and the outer surface of the upper end of the roll paper R is held by the concave portion 41 of the upper holding member 4. This arrangement allows coreless-type roll paper R, i.e., roll paper having no winding core, to be securely held in the outer case 2.

Second Embodiment

Figure 14:
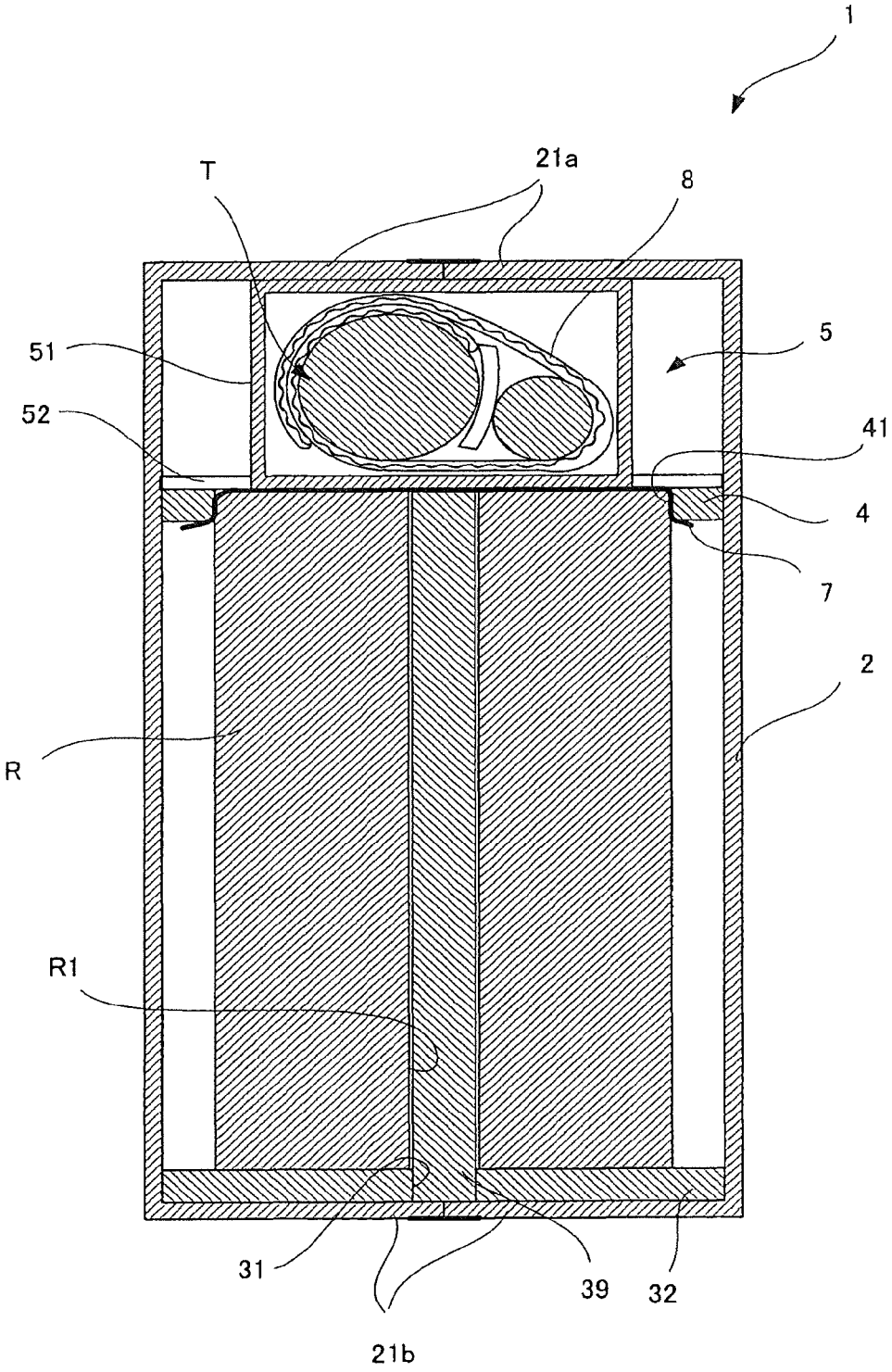
FIG. 14 is a front sectional view showing the package structure for roll paper according to the second embodiment.
Figure 15:
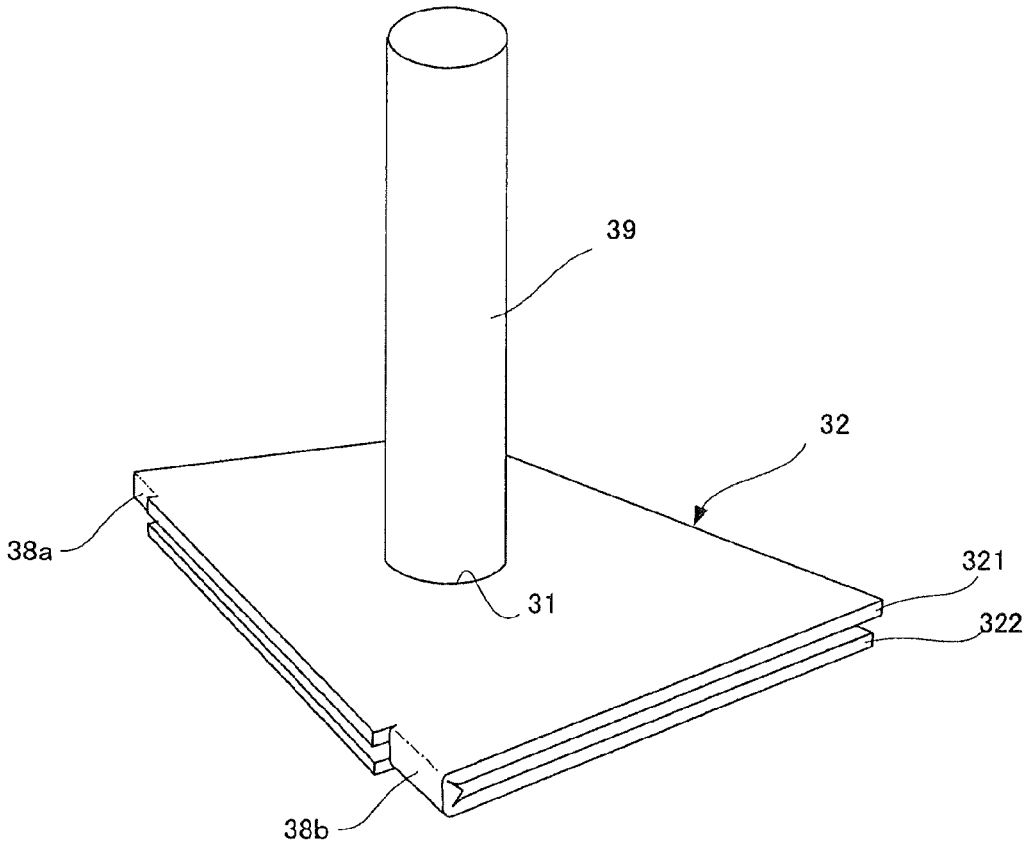
FIG. 15 is a perspective view showing a base member having a rod-like member attached thereto according to the second embodiment.
Figure 16:
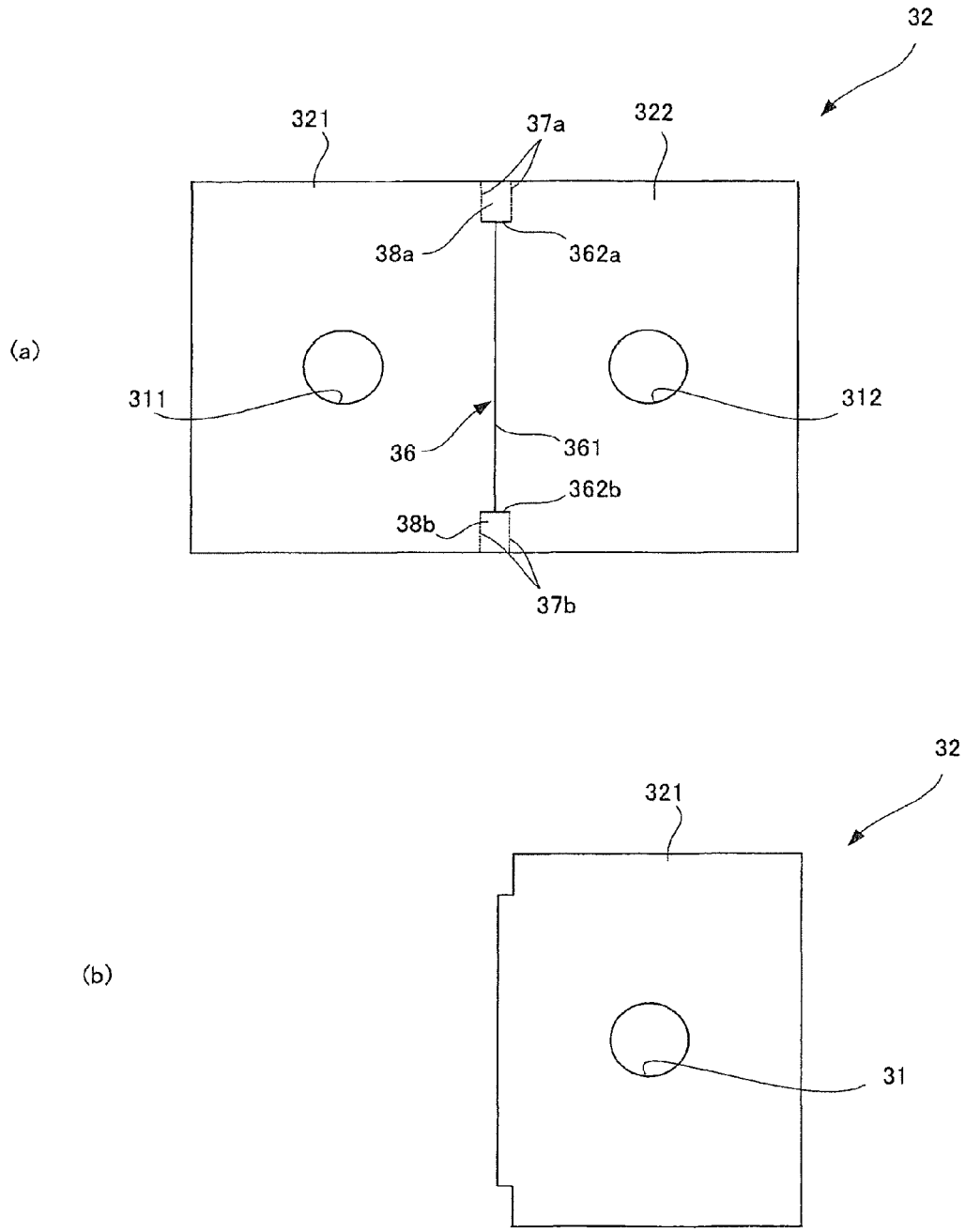
FIGS. 16(*a*) and 16(*b*) are plan views showing the base member according to the second embodiment before folding (a) and after folding (b).
Figure 18:
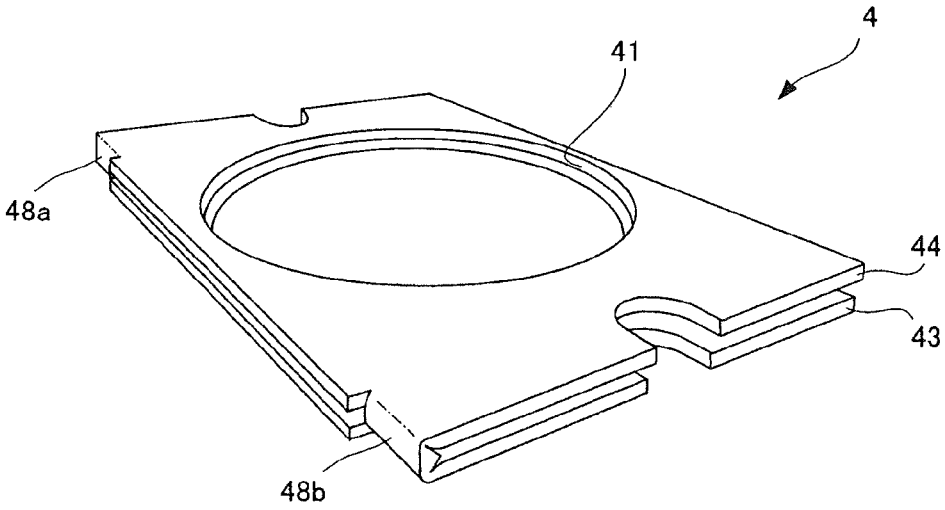
FIG. 18 is a perspective view showing the upper holding member according to the second embodiment.

A package structure for roll paper according to the second embodiment of the present invention is described below with reference to the drawings. FIG. 14 is a front sectional view showing the package structure for roll paper according to the second embodiment. FIG. 15 is a perspective view showing a base member having a rod-like member attached thereto according to the second embodiment. FIGS. 16(*a*) and 16(*b*) are plan views showing the base member according to the second embodiment before folding (a) and after folding (b). FIGS. 17(*a*) and 17(*b*) are plan views showing the upper holding member according to the second embodiment before folding (a) and after folding (b). FIG. 18 is a perspective view showing the upper holding member according to the second embodiment.

As shown in FIG. 14, the package structure 1 comprises a rectangular parallelepiped-like outer case 2. The outer case 2 sequentially comprises, from the bottom, a base member 32 having a rod-like member 39 extending upward, an upper holding member 4 for holding the upper end of the roll paper R, and a storage box 5 for storing an ink ribbon T. In this package structure, the roll paper R is stored in the space between the base member 32 and the upper holding member 4. Note that because the axis portion of the roll paper R does not have a winding core, a hollow portion R1 having a circular cross-sectional shape is formed in such a manner that it extends in the axial direction.

The components forming the package structure 1 are described in detail below. The outer case 2 has the same structure as that in the first embodiment; therefore, the detailed description is omitted here.

As shown in FIGS. 14 and 15, the base member 32 is located on the bottom surface of the outer case 2. The base member 32 is formed to have a plate-like shape having an external shape that fits the outer case 2. A cylindrical rod-like member 39 upwardly extends from the central part of the base member 32. The base member 32 has a rectangular shape as seen in a plan view, and an external shape substantially the same as the cross-sectional shape of the outer case 2. A concave portion 31 is formed in the central part of the base member 32. The concave portion 31 in the second embodiment is different from that in the first embodiment described above. The concave portion 31 in the second embodiment does not receive the roll paper R; instead, the lower end of a rod-like member 39 is inserted therein. Here, the outside diameter of the rod-like member 39 is substantially the same as the inside diameter of the concave portion 31 of the base member 32. Therefore, when the lower end of the rod-like member 39 is inserted into the concave portion 31, the lower end of the rod-like member 39 fits and is held by the concave portion 31. Furthermore, because the outside diameter of the rod-like member 39 is substantially the same as the inside diameter of the hollow portion R1 of the roll paper R, when the rod-like member 39 is inserted into the hollow portion R1 of the roll paper R, the roll paper R is held by the rod-like member 39 of the lower holding member 3. It is preferable that the rod-like member 39 be formed from paper. However, if something other than paper is to be used, acrylonitrile butadiene styrene (ABS), polystyrene (PS), polypropylene (PP) or like plastic is preferably used.

As shown in FIG. 16(*a*), the base member 32 is composed of a first base member 321 and a second base member 322 each having an external shape that is substantially the same as the cross-sectional shape of the outer case 2. The first base member 321 has a first through hole 311 in its central part. Similarly, the second base member 322 has a second through hole 312 in its central part. These first and second through holes 311,312 have the same shape, and their inside diameters are substantially the same as the outside diameter of the rod-like member 39. The first base member 321 and the second base member 322 are integrally formed, and may be formed from a piece of corrugated paper, etc. An I-shaped slit line 36 is made between the first base member 321 and the second base member 322 by making a slit in such a manner that it reaches the back surfaces. The I-shaped slit line is composed of a vertical slit line 361 that extends vertically, and horizontal slit lines 362*a*,362*b* that respectively meet the upper end and lower end of the vertical slit line 361. Thereafter, folding lines 37*a* and folding lines 37*b* are formed, wherein one folding line 37*a* extends from the right end of the horizontal slit line 362*a* toward the upper end of the base member 32, and another folding line 37*a* extends from the left end of the horizontal slit line 362*a* toward the upper end of the base member 32, and one folding line 37*b* extends from the right end of the horizontal slit line 362*b* toward the lower end of the base member 32, and another folding line 37*b* extends from the left end of the horizontal slit line 362*b* toward the lower end of the base member 32. The horizontal slit line 362*a* and folding lines 37*a* define a connecting part 38*a* that connects the second base member 322 to the first base member 321. Likewise, the horizontal slit line 362*b* and the folding lines 37*b* define a connecting part 38*b* that connects the second base member 322 to the first base member 321. It is preferable that the width of the connecting parts 38*a*,38*b* be substantially the same as the total thickness of the first base member 321 and the second base member 322.

The base member 32 is formed so that the first base member 321 can be valley folded relative to the second base member 322 by using the I-shaped slit line 36 and the folding lines 37*a*,37*b*. To be more specific, the first base member 321 is valley folded to lie on top of the second base member 322 (FIGS. 15 and 16(*b*)) from the unfolded condition shown in FIG. 16(*a*). When the first base member 321 is folded to lie on top of the second base member 322 as described above, the first through hole 311 is stacked with the second through hole 312. The first and second through holes 311,312 thereby form a concave portion 31.

The explanation continues with reference to FIG. 14. The base member 32 and the rod-like member 39 having the structures as described above are placed on the bottom surface of the outer case 2, and the rod-like member 39 is then inserted into the hollow portion R1 of the roll paper R. This allows the roll paper R to be securely held by the base member 32 and the rod-like member 39. A buffer sheet 7 similar to that used in the first embodiment is provided so as to cover the upper end of the roll paper R that is held in the manner described above.

An upper holding member 4 is disposed in the outer case 2 in such a manner that it holds the upper end of the roll paper R that is covered with the buffer sheet 7. As shown in FIGS. 17 and 18, the upper holding member 4 is composed of a first holding member 43 and a second holding member 44 each having an external shape substantially the same as the cross-sectional shape of the outer case 2.

As shown in FIG. 17(*a*), the first holding member 43 has a first through hole 411 in its central part. Similarly, the second holding member 44 has a second through hole 412 in its central part. These first and second through holes 411,412 have substantially the same shape and an inside diameter that is almost the same as the outside diameter of the roll paper R. In the upper holding member 4, the first holding member 43 and the second holding member 44 are integrally formed, and may be formed from a piece of corrugated paper, etc. Between the first holding member 43 and the second holding member 44, an I-shaped slit line 46 composed of a vertical slit line 461 and horizontal slit lines 462*a*,462*b*, and folding lines 47*a*,47*b* are faulted. A connecting part 48*a* is defined by the horizontal slit line 462*a* and the folding lines 47*a*. Likewise, the horizontal slit line 462*b* and the folding lines 47*b* define a connecting part 48*b*. These connecting parts 48*a*,48*b* respectively connect the first holding member 43 to the second holding member 44. In the upper holding member 4, the first holding member 43 and the second holding member 44 each has semicircular notches 49 in the central parts of the upper and lower ends. By forming the semicircular notches 49, the operator can easily remove the upper holding member 4 from the outer case 2 by inserting a finger therein, thus improving usability.

By providing an I-shaped slit line 46 and folding lines 47*a*,47*b*, the second holding member 44 can be valley folded relative to the first holding member 43. To be more specific, the second holding member 44 is valley folded to lie on top of the first holding member 43 (FIGS. 17(*b*) and 18) from the unfolded condition shown in FIG. 17(*a*). The upper holding member 4 is disposed in the outer case 2 with the second holding member 44 in this folded condition. In this folded condition, the first through hole 411 of the first holding member 43 is stacked with the second through hole 412 of the second holding member 44 to form a concave portion 41 that is composed of the first and second through holes 411,412. The concave portion 41 is formed as a through hole penetrating the first holding member 43 and the second holding member 44.

The upper holding member 4 having the structure as described above is placed in the outer case 2, and the upper end of the roll paper R is inserted into the concave portion 41. This arrangement allows the upper end of the roll paper R to fit and be held by the concave portion 41 because the roll paper R has an outside diameter that is substantially the same as the inside diameter of the concave portion 41. A storage box 5 is provided on top of the upper holding member 4 having the upper end of the roll paper R secured thereto. The storage box 5 has a structure similar to that employed in the first embodiment as shown in FIGS. 6 to 8.

A packaging method using the above-described package structure 1 for roll paper is described with reference to the drawings. First, an outer case 2 is prepared as shown in FIG. 14. The flap 21*b* is closed and packaging tape is then applied thereto to form the bottom-surface of the outer case 2. A base member 32 having the lower end of a rod-like member 39 inserted into the concave portion 31 is placed in the outer case 2 in such a manner that the rod-like member 39 faces upward. The base member 32 is pressed down until the bottom surface of the base member 32 contacts the bottom surface of the outer case 2. As described above, because the base member 32 has an external shape that is substantially the same as the shape of the bottom surface of the outer case 2, the base member 32 fits and is secured to the inside of the outer case 2 when the base member 32 is placed in the outer case 2.

Subsequently, the roll paper R is placed in the outer case 2 in such a manner that the rod-like member 39 is inserted into the hollow portion R1 of the roll paper R, so that the roll paper R is securely held by the rod-like member 39 and the base member 32. A buffer sheet 7 is placed on the roll paper R, and the upper holding member 4 is then disposed in the outer case 2 on top of the buffer sheet 7 in such a manner that the upper end of the roll paper R is inserted into the concave portion 41. Because the upper holding member 4 has an external shape that is substantially the same as the cross-sectional shape of the outer case 2, the upper holding member 4 fits and is secured to the outer case 2. Furthermore, because the concave portion 41 of the upper holding member 4, which is steadily held by the outer case 2, has an inside diameter that is substantially the same as the outside diameter of the roll paper R, the roll paper R fits and is secured to the concave portion 41 of the upper holding member 4. In the same manner as in the first embodiment described above, a storage box 5 having an ink ribbon T stored therein is placed in the outer case 2 and the top surface of the outer case 2 is then closed.

In the second embodiment described above, because the base member 32 and the upper holding member 4 each has an external shape that fits the outer case 2, the base member 32 and the upper holding member 4 fit and are secured to the inside of the outer case 2 when placed therein. A rod-like member 39 extends upward from the base member 32 that thus fits and is held by the outer case 2, and the rod-like member 39 has an outside diameter that is substantially the same as the inside diameter of the hollow portion R1 of the roll paper R. This allows the roll paper R to maintain its position in the outer case 2 when the roll paper R is stored in the outer case 2 with the rod-like member 39 being inserted into the hollow portion R1. The upper holding member 4 having a concave portion 41 fits and is held in a location above the base member 32 in the outer case 2, wherein the inside diameter of the concave portion 41 is substantially the same as the outside diameter of the roll paper R. This arrangement prevents the upper end of the roll paper R from swinging with the lower end of the roll paper R serving as a center, because the upper end of the roll paper R that is held by the base member 32 and the rod-like member 39 is inserted into the concave portion 41 of the upper holding member 4. As described above, the roll paper R is held by inserting the rod-like member 39 into the hollow portion R1 of the roll paper R. This makes it unnecessary to hold the outer surface of the roll paper R, making it possible to reduce the size of the base member 32. The upper holding member 4 holds the outer surface of the roll paper R, but, as described above, because the lower holding member 3 holds the roll paper R, the upper holding member 4 is only required to prevent the movement of the roll paper R. It is therefore unnecessary to make the upper holding member 4 large. This provides a package structure 1 that can securely hold a coreless roll paper R without increasing transportation costs.

Third Embodiment

Figure 20:
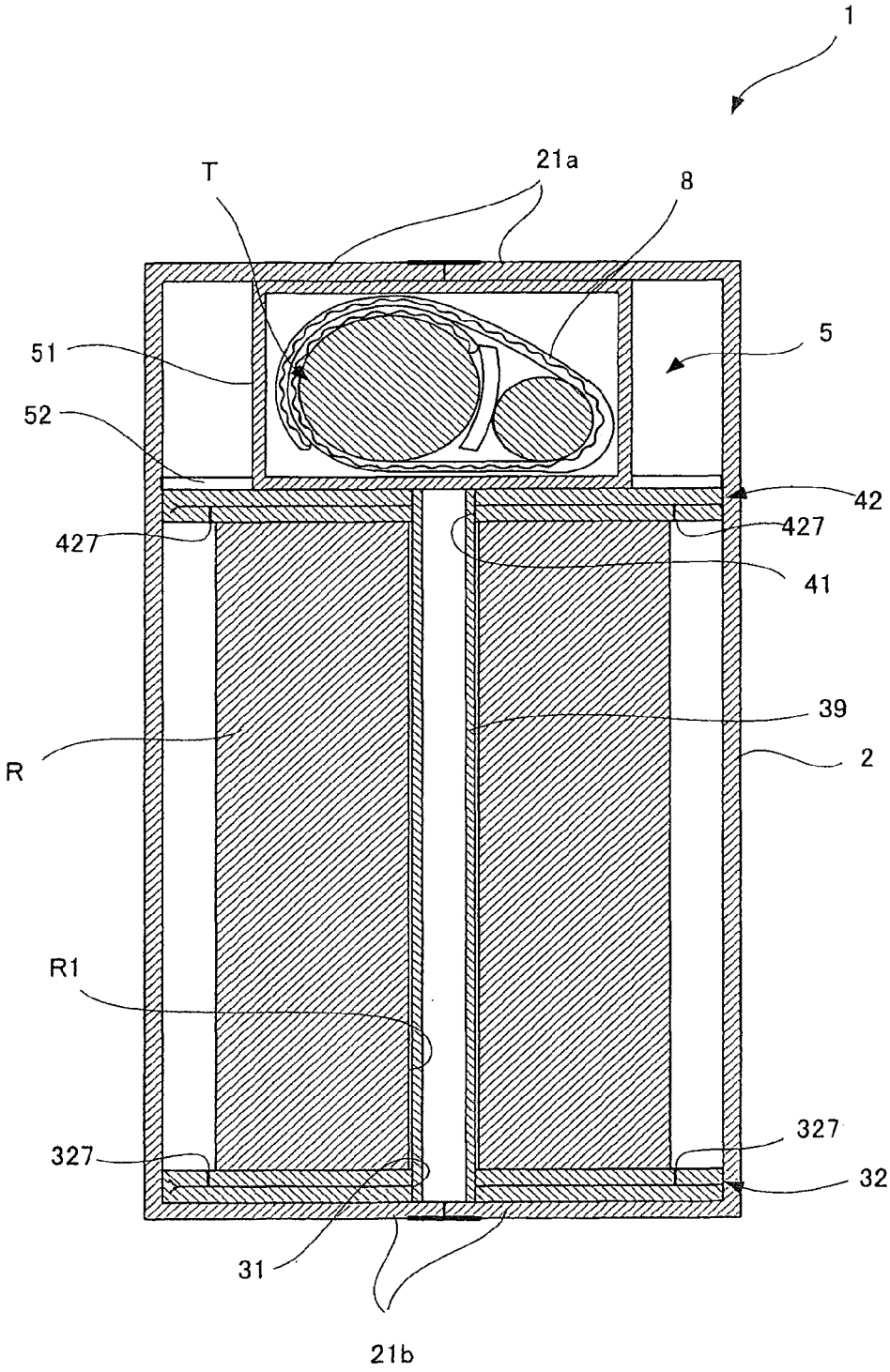
FIG. 20 is a front sectional view showing the package structure for roll paper according to the third embodiment.
Figure 21:
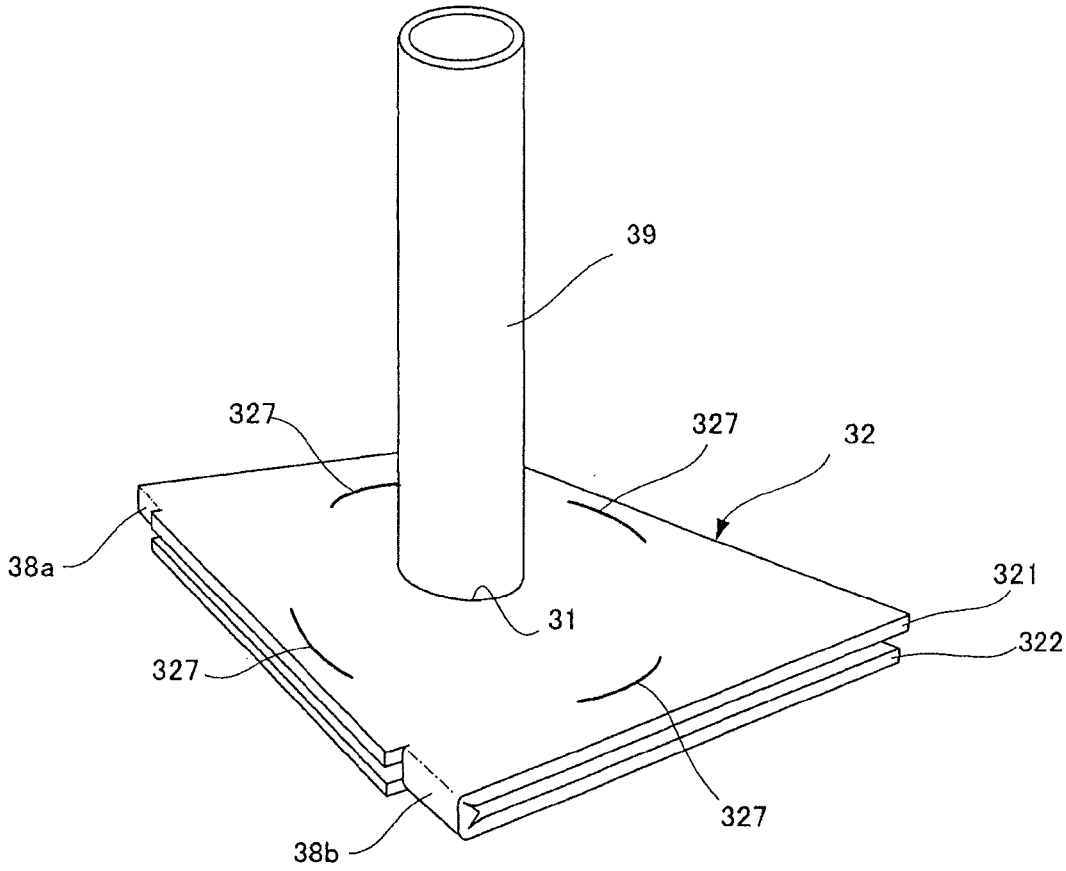
FIG. 21 is a perspective view showing the lower base member having a rod-like member attached thereto according to the third embodiment.
Figure 24:
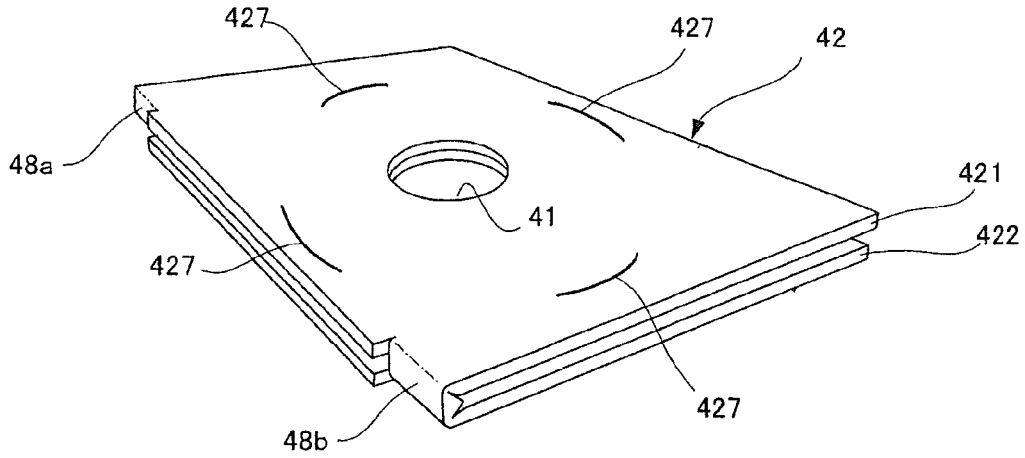
FIG. 24 is a perspective view showing the upper base member according to the third embodiment.

A package structure for roll paper according to the third embodiment of the present invention is described with reference to the drawings. FIG. 20 is a front sectional view showing the package structure for roll paper according to the third embodiment. FIG. 21 is a perspective view showing the lower base member, to which a rod-like member is mounted, according to the third embodiment. FIGS. 22(*a*) and 22(*b*) are plan views showing the base member according to the third embodiment before folding (a) and after folding (b). FIG. 23 is a plan view showing the upper base member according to the third embodiment before folding (a) and after folding (b). FIG. 24 is a perspective view showing the upper base member according to the third embodiment.

As shown in FIG. 20, a package structure 1 comprises a rectangular parallelepiped-like outer case 2, wherein a lower base member 32 is provided on the bottom surface of the outer case 2. Roll paper R is disposed on the lower base member 32, and an upper base member 42 is placed on the roll paper R. This arrangement allows the roll paper R to be held between the lower base member 32 and the upper base member 42. The roll paper R is a so-called coreless roll paper, i.e., with no winding core in its axis portion. A rod-like member 39 is inserted in the hollow portion R1 of the roll paper R. The lower end of the rod-like member 39 is inserted into a concave portion 31 that is formed at the central part of the lower base member 32, and the upper end of the rod-like member 39 is inserted into a concave portion 41 that is formed at the central part of the upper base member 42. The rod-like member 39 thus holds the roll paper R in such a manner that the lower end and the upper end thereof are respectively removably secured to the lower base member 32 and the upper base member 42. A storage box 5 with an ink ribbon (an object to be stored) T stored therein is placed on top of the upper base member 42.

The components composing the package structure 1 are described in detail below. A description of the outer case 2 is omitted here because it has the same structure as that of the first embodiment.

The lower base member 32 is located on the bottom surface of the outer case 2. As shown in FIGS. 20 and 21, the lower base member 32 has a rectangular shape as seen in a plan view and an external shape that is substantially the same as the cross-sectional shape of the outer case 2. A concave portion 31 is formed at the central part of the lower base member 32. Similar to the second embodiment, the concave portion 31 is for inserting the lower end of a rod-like member 39 therein, rather than for inserting the roll paper R therein. In this structure, because the outside diameter of the rod-like member 39 has substantially the same size as the inside diameter of the concave portion 31 of the lower base member 32, the lower end of the rod-like member 39 fits and is held by the concave portion 31 when the lower end of the rod-like member 39 is inserted into the concave portion 31.

As shown in FIG. 22(*a*), the lower base member 32 has the same structure as the base member 32 of the second embodiment except that slits 327 are formed therein. The slits 327 are intermittently formed in the first base member 321 so that a circle is defined around the first through hole 311. The diameter of the circle defined by the slits 327 is substantially the same as or slightly larger than the diameter of the roll paper R to be packaged. More preferably, the circle defined by the slits 327 has a diameter that is larger than that of the roll paper R to be stored by approximately 0.05 to 5 mm, and still more preferably, larger by approximately 0.1 to 3 mm. The first base member 321 and the second base member 322 are integrally formed and may be formed from a piece of Corrugated paper, foamed polypropylene, foamed polyethylene, foamed polystyrene, etc.

Similar to the second embodiment, in the lower base member 32, a slit line 36, folding lines 37, and a connecting part 38 are formed between the first base member 321 and the second base member 322. The first base member 321 is valley folded to lie on the second base member 322 (FIG. 21 and FIG. 22(*b*)) from the unfolded condition shown in FIG. 22(*a*). When the second base member 322 and the first base member 321 are in this folded condition, the first through hole 311 is stacked with the second through hole 312, and a concave portion 31 composed of the first and the second through holes 311,312 is thereby formed. The lower base member 3 is placed, in this folded condition, into the outer case 2.

The explanation continues with reference to FIGS. 20 and 21. By inserting the lower end of the rod-like member 39 into the concave portion 31 of the lower base member 32 having the above-described structure, the rod-like member 39 can be removably secured to the lower base member 32. The rod-like member 39 is cylindrically formed and has an outside diameter that is substantially the same as the inside diameter of the hollow portion R1 of the roll paper R. Preferably, the rod-like member 39 has an outside diameter that differs from the inside diameter of the hollow portion R1 of the roll paper R by ±0.3 to 1.0 mm, and more preferably by ±0.3 to 0.5 mm. Because the rod-like member 39 thus has an outside diameter that is substantially the same as the inside diameter of the hollow portion R1 of the roll paper R, the roll paper R can be securely held when the rod-like member 39 is inserted into the hollow portion R1 of the roll paper R. The rod-like member 39 is formed to be longer than the length of the roll paper R in the axial direction. To be more specific, it is preferable that the rod-like member 39 have a length that is equal to the sum of the length of the roll paper R in the axial direction plus the depth of the concave portion 31 of the lower base member 32 and the depth of the concave portion 41 of the upper base member 42; however, it will be sufficient if the rod-like member 39 has a length that is longer than the sum of the length of the roll paper R in the axial direction and the depth of the concave portion 31 of the lower base member 32. Having such a length, when inserted in the hollow portion R1 of the roll paper R, the ends of the rod-like member 39 will protrude from the top and bottom surfaces of the roll paper R. The rod-like member 39 can be removably secured to the base members 32,42, by inserting each of the ends of the rod-like member 39 protruding from the roll paper R into the concave portions 31,41 of the base members 32,42 respectively. It is preferable that the rod-like member 39 be formed from paper.

However, if something other than paper is to be used, acrylonitrile butadiene styrene (ABS), polystyrene (PS), polypropylene (PP) or like plastic is preferably used.

The upper base member 42 is placed on the roll paper R so that the roll paper R having the rod-like member 39 inserted therein is held between the upper base member 42 and the lower base member 32. As shown in FIGS. 23 and 24, the upper base member 42 has a shape that is substantially the same as that of the lower base member 32. The upper base member 42 is composed of the first base member 421 and the second base member 422 each having an external shape that is substantially the same as that of the outer case 2.

As shown in FIG. 23(*a*), a first through hole 411 is formed at the central part of the first base member 421, wherein the first through hole 411 has an inside diameter that is substantially the same as the outside diameter of the rod-like member 39. A second through hole 412 having a similar inside diameter is formed at the central part of the second base member. The first base member 421 has slits 427 that are similar to slits 327 formed in the lower base member 32. The first base member 421 and the second base member 422 are integrally formed. An I-shaped slit line 46 composed of a vertical slit line 461, horizontal slit lines 462*a*,462*b*, and folding lines 47*a*,47*b* are formed between the first base member 421 and the second base member 422. A connecting part 48*a* is defined by the horizontal slit line 462*a* and the folding lines 47*a*, and a connecting part 48*b* is defined by the horizontal slit line 462*b* and the folding lines 47*b*. The first base member 421 and the second base member 422 are connected to each other by the connecting parts 48*a*,48*b*.

By providing the I-shaped slit line 46 and the folding lines 47*a*,47*b*, the first base member 421 can be valley folded relative to the second base member 422. Specifically, from the unfolded condition shown in FIG. 23(*a*), the first base member 421 is valley folded to lie on top of the second base member 422 (FIGS. 23(*b*) and 24). In this folded condition, the upper base member 42 is placed in the outer case 2. Further, in this folded condition, the first through hole 411 of the first base member 421 lies on top of the second through hole 412 of the second base member 422, forming a concave portion 41 composed of the first and second through holes 411,412.

When the upper base member 42 having the above-described structure is placed in the outer case 2 in such a manner that the upper end of the rod-like member 39 is inserted in the concave portion 41, because the outside diameter of the rod-like member 39 is substantially the same as the inside diameter of the concave portion 41, the upper end of the rod-like member 39 can be removably fixed to the concave portion 41. Similar to the first embodiment, a storage box 5 for storing an ink ribbon, etc., as shown in FIGS. 6 to 8 is placed on top of the upper base member 42 to which the upper end of the rod-like member 39 is secured.

A packaging method using the package structure 1 for roll paper is described below with reference to the drawings. First, an outer case 2 is prepared as shown in FIG. 20, and a packaging tape is applied thereto with the flap 21*b* closed to form the bottom surface. Thereafter, the lower base member 32 is inserted into the outer case 2, and the lower base member 32 is pressed down until its bottom surface contacts the bottom surface of the outer case 2. When the lower base member 32 is placed in the outer case 2 in the manner as described above, because the external shape of the lower base member 32 closely matches the shape of the bottom surface of the outer case 2, the lower base member 32 can be secured by its fit with the outer case 2. Note that when the lower base member 32 is placed in the outer case 2, the first base member 321 having the slit 327 formed therein should face upward, i.e., toward the roll paper R.

Subsequently, the roll paper R to be stored is prepared. The rod-like member 39 is inserted into the hollow portion R1 of the roll paper R, and the roll paper R having the rod-like member 39 inserted therein is placed in the outer case 2. In this case, the roll paper R is stored in the outer case 2 in such a manner that the lower end of the rod-like member 39 protruding from the hollow portion R1 of the roll paper R is inserted into the concave portion 31 of the lower base member 32. The upper base member 42 is placed in the outer case 2 in such a manner that the upper end of the rod-like member 39 protruding from the upper end of the roll paper R that is held by the lower base member 32 and the rod-like member 39 is inserted into the concave portion 41. Note that when the upper base member 42 is placed in the outer case 2, the first base member 421 having the slits 427 faces downward, i.e., toward the roll paper R. Because the upper base member 42 has an external shape that is substantially the same as the cross-sectional shape of the outer case 2, the upper base member 42 is secured by its fit with the outer case 2. Furthermore, because the inside diameter of the concave portion 41 of the upper base member 42 secured by its fit with the outer case 2 is substantially the same as the outside diameter of the rod-like member 39, the upper end of the rod-like member 39 can be removably fixed to the concave portion 41 of the upper base member 42.

A storage box 5, in which an ink ribbon T is stored in the same manner as in the first embodiment, is placed on top of the upper base member 42 in the outer case 2. In such a condition, the storage box 5 is secured to the inside of the outer case 2 by the box unit 51 and four vane-like portions 52; therefore, the storage box 5 cannot move in the horizontal direction inside the outer case 2. Furthermore, when the storage box 5 is placed in the outer case 2, because the upper base member 42 is pressed toward the lower base member 32 by the weight of the storage box and the ink ribbon T stored therein, the roll paper R is securely held between the lower base member 32 and the upper base member 42. When the roll paper R is sandwiched between the lower base member 32 and the upper base member 42 as described above, the bottom and top surfaces of the roll paper R are held in the region surrounded by the slits 327,427 of base members 32,42. As the last step, a packaging tape is applied thereto with the flap 21*a* of the outer case 2 closed to form the top surface of the outer case 2.

As described above, in the third embodiment, the rod-like member 39 is inserted into the hollow portion R1 in the roll paper R, wherein the lower end of the rod-like member 39 is held by the lower base member 32, and the upper end of the rod-like member 39 is held by the upper base member 42. This arrangement allows the roll paper R to be secured to the inside of the outer case 2. This makes it unnecessary to hold the outer surface of the roll paper R in order to fix the position of the roll paper R, reducing the size of the lower base member 32 and the upper base member 42. Each of the base members 32,42 respectively has slits 327,427; therefore, the outer periphery in the region defined by the slits 327,427 easily become concave. This characteristic is advantageous because even if the roll paper R starts to move in the vertical direction, or if the roll paper R starts to lean, with a top or bottom edge portion thereof serving as a base, the motion of the roll paper R will be absorbed and the pressure that is applied to the top surface or bottom surface, or to the top or bottom edge portion, thereof will be reduced, preventing deformation of the edge portion of the roll paper R.

Figure 11:
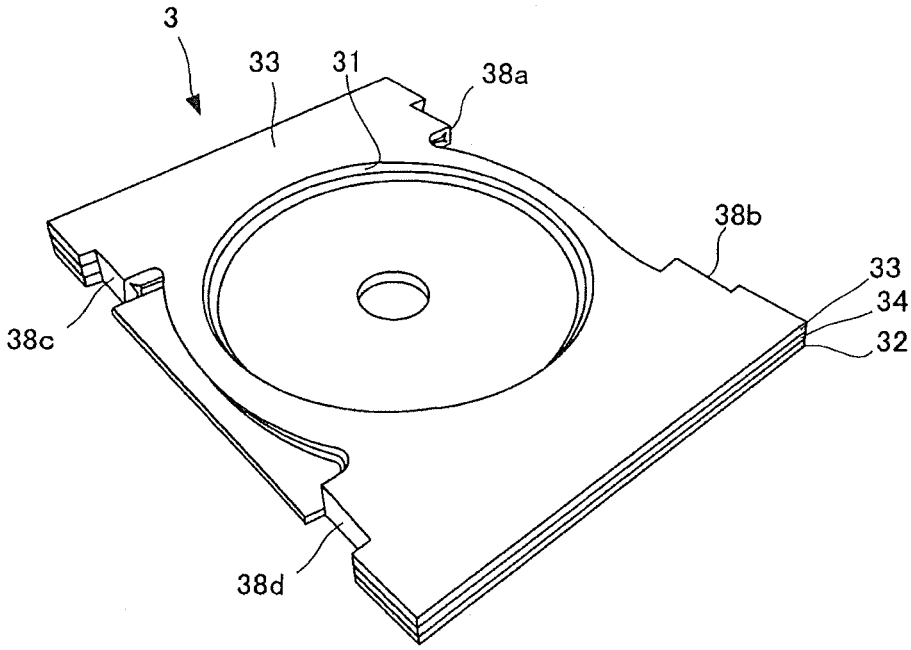
FIG. 11 is a perspective view showing the lower holding member and the upper holding member according to a modified example of the first embodiment.

The embodiments of the present invention are described above; however, the scope of the present invention is not limited to those embodiments and various modifications can be made as long as such modifications do not depart from the intention of the present invention. For example, in the first embodiment, at least one of the lower holding member 3 and the upper holding member 4 may have the following structure. Specifically, as shown in FIGS. 10 and 11, the lower holding member 3 is composed of a base member 32 having an external shape that fits the cross-sectional shape of the outer case 2, a first holding member 33 having a first through hole 311 formed therein, and a second holding member 34 having a second through hole 312 formed therein. The first through hole 311 and the second through hole 312 have the same shape.

As shown in FIG. 10(*a*), the base member 32 and the first and second holding members 33,34 are integrally formed using, for example, a piece of corrugated paper. A drum-shaped punch hole 301*a* is formed between the first holding member 33 and the second holding member 34. In the upper end of the lower holding member 3, a slit line 36*a* having an inverted T-shape is formed by making a slit that reaches the back surface. In the lower end of the lower holding member 3, a T-shaped slit line 36*b* having a slit that reaches the back surface is formed. Folding lines 37*a*,37*b* are formed in such a manner that they extend respectively from the right end and the left end of the horizontal slit lines 362*a*,362*b*, in the inverted. T-shaped or T-shaped slit lines 36*a*,36*b*, toward the drum-shaped punch-hole 301*a*. The first connecting part 38*a* is defined by the horizontal slit line 362*a*, the folding lines 37*a*, and the punch-hole 301*a*. Similarly, the second connecting part 38*b* is defined by the horizontal slit line 362*b*, the folding lines 37*b*, and the punch-hole 301*a*. It is preferable that the widths of the connecting parts 38*a*,38*b* be substantially the same as the total of the thickness of the first holding member 33 and the second holding member 34. By providing the inverted T-shaped or T-shaped slit lines 36*a*,36*b* and the folding lines 37*a*,37*b*, the second holding member 34 can be valley folded relative to the first holding member 33.

A punch-hole 301*b* having a shape that is half of the drum-shaped punch-hole 301*a*, i.e., as if the punch-hole 301*a* were cut in half vertically, is formed between the first holding member 33 and the base member 32. Horizontal slit lines 362*e*,362*f* are formed at the right upper end and the right lower end of the punch-hole 301*b*, with the slit lines facing the right direction thereof. These horizontal slit lines 362*e*,362*f* are formed so as to reach the back surface. The inverted T-shaped or T-shaped slit lines 36*c*,36*d* described above are respectively formed in the upper end and the lower end of the lower holding member 3. Folding lines 37*c*,37*d* are respectively formed from the left end of the horizontal slit lines 362*c*,362*d* in the inverted T-shaped or T-shaped slit lines 36*c*,36*d*, wherein the lines 37*c*,37*d* face toward the punch-hole 301*b*. Similarly, folding lines 37*c*,37*d* are respectively foamed from the right end of the horizontal slit lines 362*c*, 362*d* facing toward the right end of the horizontal slit lines 362*e*,362*f*. The horizontal slit line 362*c*, the slit line 362*e*, the folding lines 37*c* and the punch-hole 301*b* define the second connecting part 38*c*. Likewise, the horizontal slit lines 362*d*, 362*f*, the folding lines 37*d* and the punch-hole 301*b* define the second connecting part 38*d*. It is preferable that the widths of the second connecting parts 38*c*,38*d* be substantially the same as the total thickness of the first holding member 33, the second holding member 34, and the base member 32. By providing the inverted T-shaped or T-shaped slit lines 36*c*,36*d* and the folding lines 37*c*,37*d*, the first holding member 33 can be valley folded relative to the base member 32.

The steps of placing the above-described lower holding member 3, which is formed from a piece of corrugated paper, in the outer case 2 and the folding procedure thereof are described below. First, the second holding member 34 is valley folded relative to the first holding member 33 (FIG. 10(*b*)) from the unfolded condition shown in FIG. 10(*a*). Subsequently, in the condition shown in FIG. 10(*b*), the first holding member 33 having the second holding member 34 lying thereon is valley folded relative to the base member 32 (FIG. 10(*c*)). FIG. 11 shows the structure of the lower holding member 3 stored in the outer case in the folded condition. Specifically, the second holding member 34 lies on the base member 32, and the first holding member 33 further lies on the second holding member 34. In this condition, with the members lying on top of one another, the first through-hole 311 is stacked on the second through-hole 312, so that the concave portion 31 is composed of the first and second through-holes 311,312. The first holding member 33 is connected to the base member 32 by the second connecting parts 38*c*,38*d*, and the first holding member 33 is connected to the second holding member 34 by the first connecting parts 38*a*, 38*b*.

Figure 12:
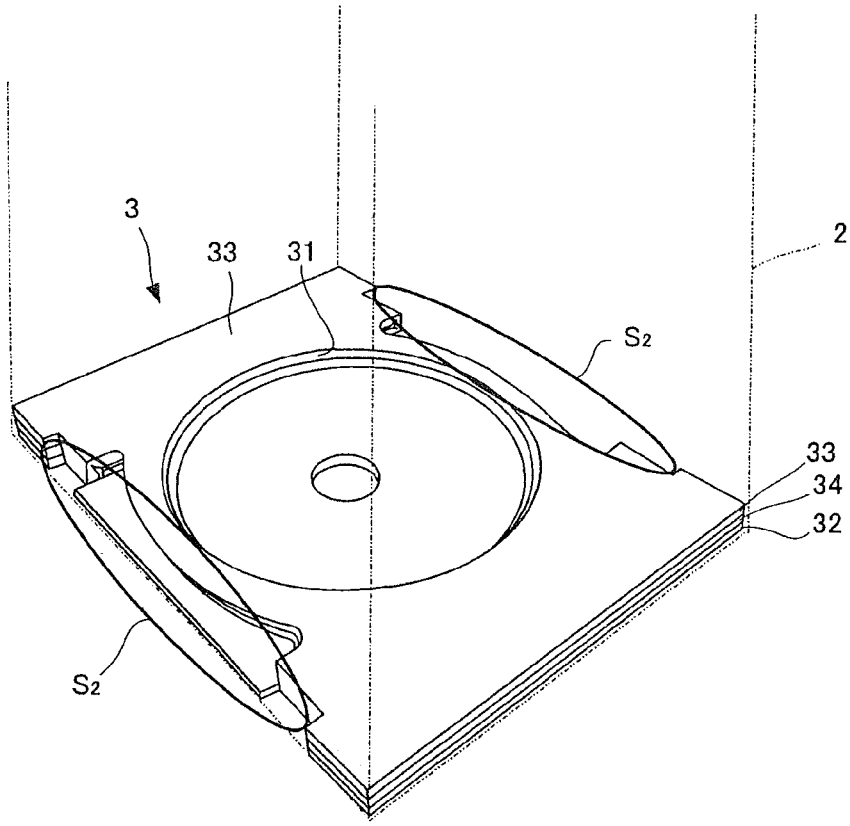
FIG. 12 is a perspective view showing the lower holding member and the upper holding member according to a modified example of the first embodiment.

The lower holding member 3 is placed in the outer case 2 in the folded condition described above, wherein each of space $S_2$ is defined between the inner wall of the outer case 2 and the first holding member 33 or the second holding member 34 (FIG. 12). Because the space $S_2$ is formed between the concave portion 31 for holding the roll paper R and the inner wall of the outer case 2, even if an impact is applied to the outer case 2 during transportation, the space $S_2$ will absorb and reduce the impact. Furthermore, formation of the space $S_2$ allows the concave portion for holding the roll paper R to shift slightly toward the inner walls of the outer case 2 in the event that the outer case 2 is dropped, reducing the impact that would be transferred from the inner walls of the concave portion 31 of the lower holding member 3 to the roll paper R. Note that the upper holding member may have the same structure as the lower holding member 3 described above.

Various other shape modifications may be made in addition to those described above. For example, in the first embodiment, the lower holding member 3 and the upper holding member 4 are formed by folding a piece of corrugated paper or the like. However, a laminated structure comprising a base member 32, a first holding member 33, and a second holding member 34 may be formed using styrofoam or the like.

In the first to third embodiments described above, the storage box 5 is provided on top of the upper holding member 4 or the upper base member 42; however, the storage box 5 may be omitted to reduce the height of the outer case 2 accordingly.

In the first embodiment, the lower holding member 3 and the upper holding member 4 are composed of the base member 32, the first holding member 33 and the second holding member 34. However, the structures thereof are not limited to these, and the base member 32 may be omitted or either of the first holding member 33 or the second holding member 34 may be omitted.

Figure 13:
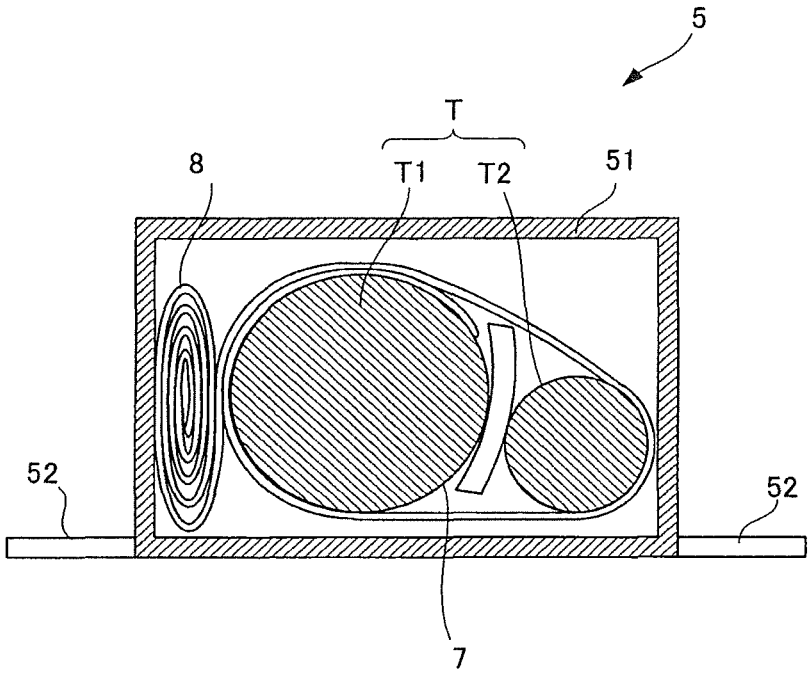
FIG. 13 is a front sectional view showing a storage box storing an ink ribbon covered with a packing sheet according to a modified example of the first to third embodiments.

In the first to third embodiments described above, the packing sheet 8 merely covers the ink ribbon T. However, for example, the packing sheet 8 may cover the ink ribbon T and the remaining portion of the packing sheet 8 may be stored in the storage box 5 adjacent to the ink ribbon T in the folded condition shown in FIG. 13.

Figure 19:
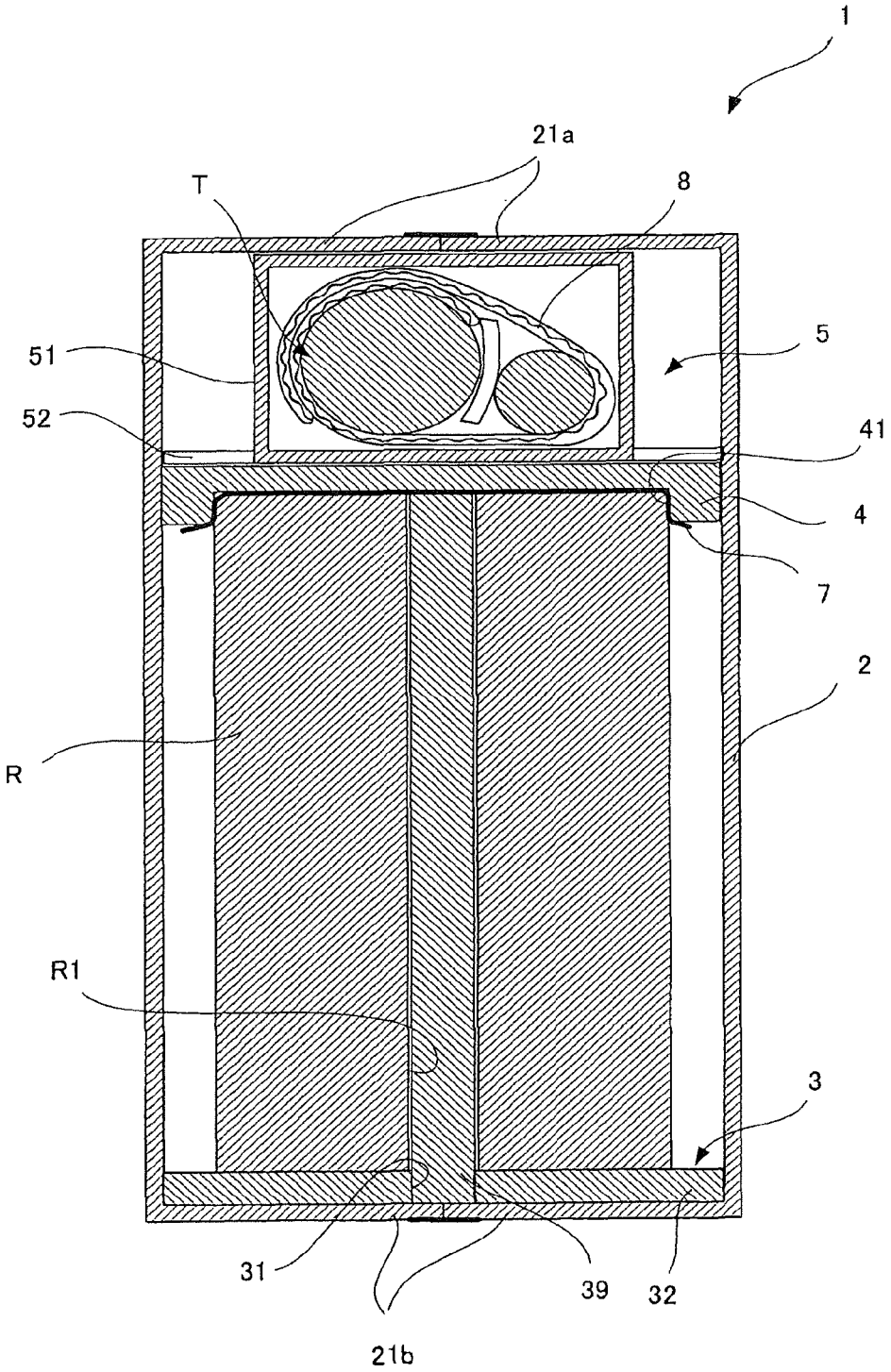
FIG. 19 is a front sectional view showing the package structure for roll paper according to a modified example of the second embodiment.

In the second embodiment, the upper holding member 4 has a concave portion 41 in the form of a through hole. However, the concave portion 41 may take a form other than a through hole, as shown in FIG. 19.

Furthermore, the base member 32 is formed separately from the rod-like member 39 in the second embodiment; however, they may be formed integrally.

In the second and third embodiments, the base member 32 or the lower base member 32, the upper holding member 4, and the upper base member 42 are formed by folding a piece of corrugated paper. However, the structures thereof are not limited to these and, for example, these members may be formed without being folded. In this case, it is preferable that the base member 32 or the lower base member 32 and the upper base member 42 have, for example, a thickness so that the rod-like member 39 can be securely held in the concave portions 31,41.

In the second embodiment, the packaging method comprises the steps of securing the rod-like member 39 in the concave portion 31 of the base member 32 and placing the base member 32 with the rod-like member 39 thereby secured to the inside of the outer case 2, and then placing the roll paper R into the outer case 2. However, a method other than this may also be employed. For example, only the base member 32 may be placed in the outer case 2. The rod-like member 39 may then be inserted into the hollow portion R1 in the roll paper R. Thereafter, the lower end of the rod-like member 39 may be made to protrude from the hollow portion R1 in the roll paper R, and the roll paper R may then be placed in the outer case 2 in such a manner that the protruding lower end of the rod-like member 39 is secured by its fit with the concave portion 31 of the base member 32.

Figure 25:
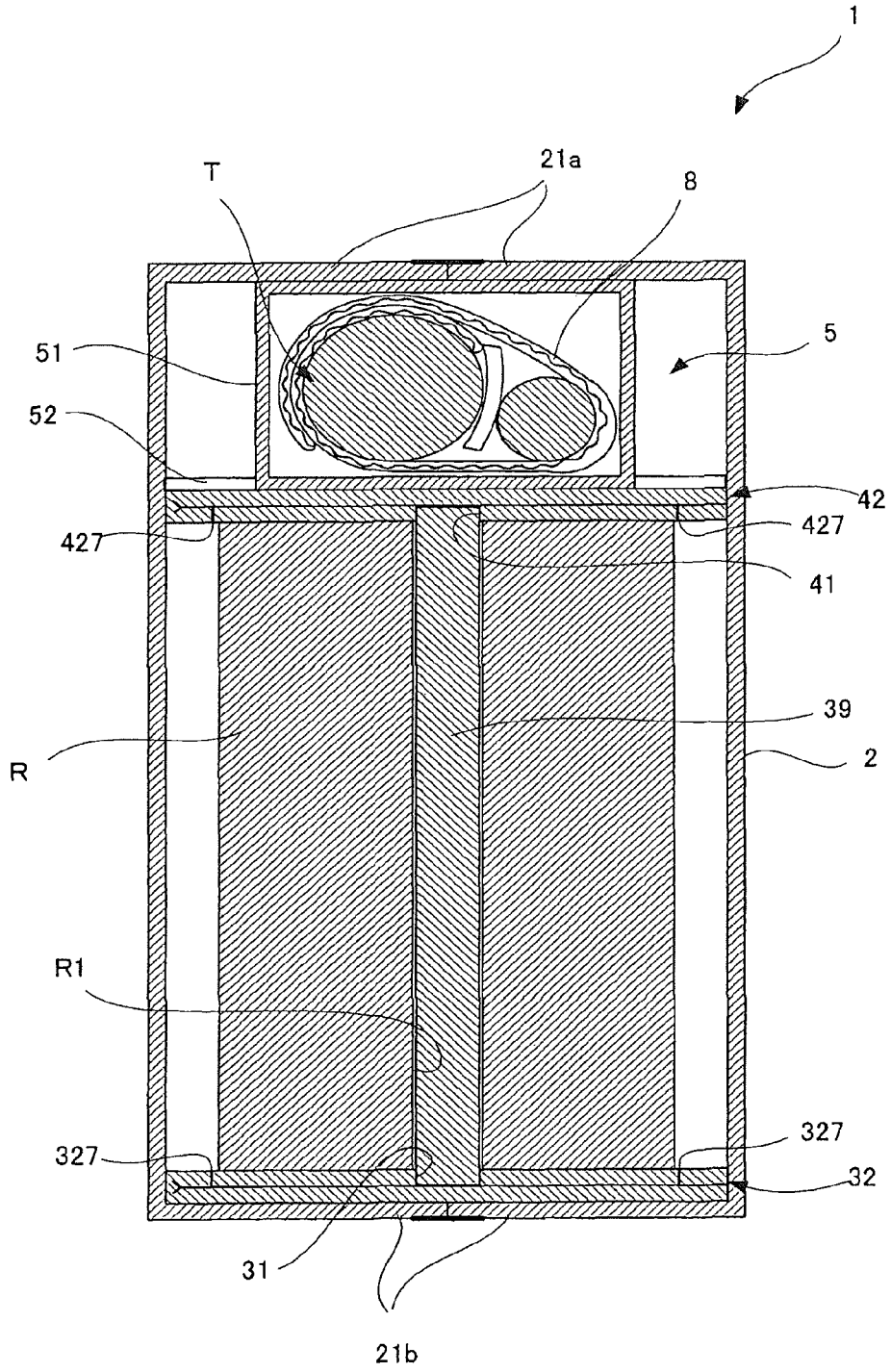
FIG. 25 is a front sectional view of the package structure for roll paper according to a modified example of the third embodiment.

In the third embodiment, the concave portions 31,41 are foamed as through holes in both the base members 32,42. However, as shown in FIG. 25, the concave portions 31,41 may also take a form other than a through hole.

Furthermore, in the third embodiment, the lower base member 32 or the upper base member 42 is each formed separate from the rod-like member 39. However, it is also possible to form, for example, the lower base member 32 and the rod-like member 39 in an integral manner, or to form the upper base member 42 and the rod-like member 39 in an integral manner.

In the third embodiment, the packaging method comprises the steps of placing the roll paper R in the outer case 2 after inserting the rod-like member 39 into the hollow portion R1 of the roll paper R as described above. However, the packaging method may be modified such that, for example, the lower end of the rod-like member 39 is inserted into the concave portion 31 of the lower base member 32, which has been placed in the outer case 2, and then placing the roll paper R in the outer case 2 in such a manner that the rod-like member 39 is inserted into the hollow portion R1. Other modifications may also be made. For example, the roll paper R may be first placed on the lower base member 32, and the location of the roll paper R may be adjusted so that the concave portion 31 of the lower base member 32 is aligned with the hollow portion R1 in the roll paper R. Thereafter, the rod-like member 39 may be inserted into the hollow portion R1 of the roll paper R, and the lower end of the rod-like member 39 may then be inserted in such a condition into the concave portion 31 of the lower base member 32.

In the third embodiment, the storage box 5 is placed on top of the upper base member 42, and the roll paper R is securely held by the lower base member 32 and the upper base member 42 by using the weight of the storage box 5 and the ink ribbon T stored therein to press the upper base member 42 toward the lower base member 32. However, the structure thereof is not limited to this and a modification may be made. For example, the upper base member 42 may be made to have a size that is firmly secured to the inside of the outer case 2 so that the movement of the roll paper R in the vertical direction is prevented. This arrangement allows the upper base member 42 to be located in a position so that the roll paper R can be securely held between the lower base member 32 and the upper base member 42. In this case, it becomes unnecessary to press the upper base member 42 toward the lower base member 32 by using the weight of the storage box 5 and the ink ribbon T stored therein. Therefore, the storage box 5 may be omitted and the height of the outer case 2 may be reduced accordingly.

In the third embodiment, as shown in FIG. 26, semicircular or like notches may also be formed in the side faces of each of the base members 32,42. Providing notches having such a form makes it easy for an operator to remove the base members 32,42 from the outer case 2, thus improving usability.

In the third embodiment, slits 327,427 are intermittently formed in each of the base members 32,42. However, these slits may also be formed continuously or in a finer intermittent pattern such as a perforated line. Furthermore, in the third embodiment, the slits 327,427 are formed so as to penetrate the first base members 321,421. However, it is also possible to form the slits in a half-cut manner, which does not penetrate the first base members 321,421.

In the third embodiment, the upper end of the rod-like member 39 is formed to be flush with the top surface of the upper base member 41. However, the upper end of the rod-like member 39 may also be long enough to protrude from the top surface of the upper base member 41.

The invention claimed is:

1. A package structure for coreless roll paper having a hollow portion instead of a winding core in the axis portion thereof, the package structure comprising:

an outer case for storing roll paper;

a base member having an external shape that fits the outer case;

a rod-like member extending upward from the base member and having an outside diameter that closely matches the inside diameter of the hollow portion of the roll paper; and an upper holding member having a concave portion whose inside diameter closely matches the outside diameter of the roll paper and an external shape that fits the outer case; and the upper holding member being placed in the outer case at a location above the base member with the concave portion thereof facing downward.

2. The package structure for roll paper according to claim 1, wherein the base member is formed separate from the rod-like member, the base member comprises a concave portion having an inside diameter that closely matches the outside diameter of the rod-like member, and one of the end portions of the rod-like member is inserted in the concave portion.

3. The package structure for roll paper according to claim 1, which further comprises a buffer sheet provided to cover the concave portion of the upper holding member for reducing impact applied thereto.

4. The package structure for roll paper according to claim 1, which further comprises a storage box disposed on top of the upper holding member, wherein the storage box is provided with a box unit for storing an object and vane-like portions extending from each side of at least one pair of facing sides of the box unit to the outer case.

5. The package structure for roll paper according to claim 4, wherein the storage box further comprises a packing sheet to cover the object, and the remaining portion of the packing sheet after covering the object is rolled up and stored in the storage box adjacent to the stored object.

* * * * *